US012433384B2

(12) United States Patent
Scicluna et al.

(10) Patent No.: US 12,433,384 B2
(45) Date of Patent: Oct. 7, 2025

(54) LUGGAGE INCLUDING MODULAR LUGGAGE FRAME

(71) Applicant: TUMI, INC., Edison, NJ (US)

(72) Inventors: Paul V. Scicluna, Delanco, NJ (US); Victor G. Sanz, Whitehouse Station, NJ (US)

(73) Assignee: TUMI, INC., Edison, NJ (US)

( * ) Notice: Subject to any disclaimer, the term of this patent is extended or adjusted under 35 U.S.C. 154(b) by 464 days.

(21) Appl. No.: 17/823,396

(22) Filed: Aug. 30, 2022

(65) Prior Publication Data

US 2023/0069446 A1 Mar. 2, 2023

Related U.S. Application Data

(60) Provisional application No. 63/238,680, filed on Aug. 30, 2021.

(51) Int. Cl.

| | |
|---|---|
| ***A45C 13/36*** | (2006.01) |
| ***A45C 5/14*** | (2006.01) |
| ***A45C 7/00*** | (2006.01) |
| ***A45C 13/26*** | (2006.01) |

(52) U.S. Cl.

CPC ..... *A45C 13/36* (2013.01); *A45C 5/14* (2013.01); *A45C 7/005* (2013.01); *A45C 13/26* (2013.01)

(58) Field of Classification Search

CPC ..... A45C 13/36; A45C 5/14; A45C 7/005; A45C 13/26; A45C 13/04

See application file for complete search history.

(56) References Cited

U.S. PATENT DOCUMENTS

| | | | | |
|---|---|---|---|---|
| 10,334 | A | 12/1853 | Cantel | |
| 2,309,029 | A | 1/1943 | Wheary, Jr. | |
| 3,044,656 | A | 7/1962 | Dobbie | |
| 3,204,905 | A | 9/1965 | Marban | |
| 3,962,010 | A | 6/1976 | Riou et al. | |
| 4,744,445 | A | 5/1988 | Anderson et al. | |
| 4,770,312 | A * | 9/1988 | O | A45C 7/0036 190/107 |

(Continued)

FOREIGN PATENT DOCUMENTS

| | | |
|---|---|---|
| CN | 2069674 U | 1/1991 |
| CN | 1468566 A | 1/2004 |

(Continued)

OTHER PUBLICATIONS

EP 2499930 English translation (Year: 2025).*

(Continued)

*Primary Examiner* — Nathan J Jenness
*Assistant Examiner* — Justin Caudill
(74) *Attorney, Agent, or Firm* — Lando & Anastasi, LLP

(57) ABSTRACT

A configurable shell (12, 14) for a configurable article of luggage (10) is disclosed. The configurable shell comprises a first panel (30) and four side panels (32, 34), an outer frame subassembly (54, 134), an inner frame subassembly (56, 136), and a central frame subassembly (50, 130). The frame subassemblies define a frame. The frame and the panels are configurable in length, width, and depth to provide the configurable shell (12, 14). Two configurable shells can be joined together to provide the configurable article of luggage (10).

21 Claims, 17 Drawing Sheets

(56) References Cited

U.S. PATENT DOCUMENTS

| | | | | |
|---|---|---|---|---|
| 5,000,301 | A * | 3/1991 | Grenier | A45C 13/36 220/4.28 |
| 5,115,895 | A | 5/1992 | Myers | |
| 6,050,373 | A | 4/2000 | Wonka et al. | |
| 6,557,955 | B2 * | 5/2003 | Saravis | A47B 47/0033 403/381 |
| 6,604,617 | B2 | 8/2003 | Davis et al. | |
| 6,936,127 | B2 | 8/2005 | Fenton et al. | |
| 8,752,683 | B2 | 6/2014 | Scicluna | |
| 9,089,964 | B2 | 7/2015 | Cheng | |
| 10,219,595 | B2 * | 3/2019 | Tonelli | A45C 5/02 |
| 10,542,805 | B2 | 1/2020 | Scicluna | |
| 2004/0124191 | A1 * | 7/2004 | Colladon | B65D 21/083 220/4.01 |
| 2005/0129460 | A1 * | 6/2005 | Medcalf | G09F 1/12 403/403 |
| 2008/0131197 | A1 | 6/2008 | Hamlen | |
| 2011/0168506 | A1 * | 7/2011 | Santy | A45C 5/02 190/125 |
| 2012/0012596 | A1 | 1/2012 | Hollebone et al. | |
| 2013/0140252 | A1 | 6/2013 | Murakami | |
| 2014/0311844 | A1 | 10/2014 | Meersschaert et al. | |
| 2015/0129384 | A1 | 5/2015 | Mertens et al. | |
| 2017/0000232 | A1 * | 1/2017 | Scicluna | A45C 13/005 |
| 2017/0006986 | A1 * | 1/2017 | Sieber | G09F 13/22 |
| 2020/0000197 | A1 * | 1/2020 | Ruan | A45C 13/1076 |
| 2022/0031037 | A1 * | 2/2022 | Bourquin | A45C 7/0045 |

FOREIGN PATENT DOCUMENTS

| | | | | |
|---|---|---|---|---|
| CN | 201403677 | Y | 2/2010 | |
| CN | 203492996 | U | 3/2014 | |
| CN | 203633635 | U | 6/2014 | |
| CN | 104287380 | A | 1/2015 | |
| CN | 205233747 | U | 5/2016 | |
| CN | 205233748 | U | 5/2016 | |
| EP | 2499930 | A1 * | 9/2012 | A45C 13/04 |
| EP | 2826394 | A1 | 1/2015 | |
| GB | 2094878 | A | 9/1982 | |
| WO | 2010029581 | A1 | 3/2010 | |
| WO | 2013072086 | A1 | 5/2013 | |
| WO | 2017082586 | A1 | 5/2017 | |

OTHER PUBLICATIONS

International Search Report and the Written Opinion of the International Searching Authority from corresponding PCT/US2016/040207 dated Oct. 4, 2016.

Office Action from Chinese Application No. 201680039294.6 dated Dec. 25, 2018.

Extended European Search Report from European Application No. 16818730.0 dated Feb. 5, 2019.

Office Action in European Patent Application No. 16818730.0 dated Apr. 15, 2021.

* cited by examiner

LUGGAGE INCLUDING MODULAR LUGGAGE FRAME

CROSS-REFERENCE TO RELATED APPLICATIONS

This application claims the benefit under 35 U.S.C. § 119(e) to U.S. Provisional Application Ser. No. 63/238,680 titled "LUGGAGE INCLUDING MODULAR LUGGAGE FRAME," filed Aug. 30, 2021, which is incorporated by reference herein in its entirety for all purposes.

FIELD OF THE INVENTION

This disclosure relates to a modular, high strength suitcase frame for piece of luggage and for a method for the manufacture thereof.

BACKGROUND

Luggage may typically be divided into two categories—soft luggage, and hard shell luggage. Soft luggage is typically wrapped in a soft material, such as cloth, canvas, leather, fabric, and/or vinyl. Soft luggage is typically constructed by forming an internal frame from metal and plastic materials which may be fastened together to define an interior compartment for storing items. Padding may then be applied to the exterior and interior of the plastic and metal frame, before a soft, cloth material is applied to the exterior and interior of the luggage by stitching and/or adhering it to the luggage frame and cushioning. Soft luggage is an attractive choice for luggage designers because it allows the designer to create more intricate details and aesthetic features in the soft, cloth material, which is easily cut, stitched, and arranged to create visually appealing luggage designs. However, soft luggage is typically less durable than hard shell luggage and is subject to tearing, ripping, and staining during the normal life of the luggage.

Hard shell luggage on the other hand is formed of a hard plastic material such as polyvinyl chloride (PVC), polyethylene (PE), polypropylene (PP), carbon fiber, or Tegris®. Hard shell luggage has the advantage of resisting deformation by external forces, which affords greater protection to the contents against damage as well as preserving the overall shape and appearance of the luggage. However, hard shell luggage can be heavier than soft luggage, and designers tend to have fewer options for altering the aesthetic appearance of hard shell luggage, given the typical methods of manufacturing hard shell luggage.

Hard shell luggage also typically requires a more complex manufacturing process, such as injection molding or vacuum forming. These processes include the use of expensive and complex molding equipment, multiple heating and cooling steps, trimming steps, and cleaning steps to produce the luggage body. Once the front and rear hard shell components of the luggage are formed they are typically adhered to a metal frame that is placed on the center-facing edge of the hard shells. Locks, hinges, and other hardware may then be connected to this metal frame. Liners and other internal components may also then be installed. This manufacturing process can be expensive and time consuming as compared to manufacturing processes for soft bags.

There is a need for a modular luggage frame that can be easily assembled from a set of modular components in a size desired by a consumer. There is a need for a modular luggage frame, the components of which may be either mass produced or produced as a single unique luggage with relatively simple and inexpensive manufacturing techniques and which components may then be adapted for various suitcase designs and assembled with less cost and labor than currently available techniques for manufacturing hard shell luggage.

SUMMARY OF THE INVENTION

The disclosure is directed to a configurable shell for a configurable article of luggage. The configurable shell comprises a first panel and four side panels, an outer frame subassembly, an inner frame subassembly, and a central frame subassembly. The frame subassemblies define a configurable frame. The frame and the panels are configurable in length, width, and depth to provide a configurable shell. Two configurable shells can be joined together to provide a configurable article of luggage.

Aspects and embodiments of the disclosure are directed to configurable shell for an article of luggage, comprising a configurable frame assembly comprising an outer frame subassembly, an inner frame subassembly, and a central frame subassembly. The outer frame subassembly and inner frame subassembly include corner pieces and elongate elements. The corner pieces and elongate members of the outer frame subassembly and inner frame sub assembly together define a portion of at least one groove. The configurable shell further includes a central frame subassembly that includes elongate members and corner members common to both inner and outer frame members and connected to the inner and outer frame members so as to form a remainder of the at least one groove defined by the outer frame subassembly, the inner frame subassembly, and the central frame subassembly.

In some aspects and embodiments, the elongate members of the configurable frame are configurable in length so as to provide the configurable frame assembly that is configurable in length, width, and depth.

In some aspects and embodiments, the inner and outer frames connect together at the corners.

In some aspects and embodiments, the configurable shell further comprising a first panel disposed in the at least one groove.

In some aspects and embodiments, the at least one groove comprises a first groove and four additional grooves.

In some aspects and embodiments, a first panel is disposed in the first groove and four additional side panels are disposed in the four additional grooves to comprise the configurable shell.

Aspects and embodiments of a configurable article of luggage comprising two such configurable shells joined together by at least one hinge element to comprise the configurable article of luggage.

In some aspects and embodiments, the outer frame assembly includes: four upper outer frame longitudinal frame members, four upper outer frame vertical members, and four upper outer frame corner frame members, each upper outer frame corner member being connectable to two of the upper outer frame longitudinal frame members and to a first end of one of the upper outer frame vertical members.

In some aspects and embodiments, the inner frame assembly includes four upper inner frame longitudinal frame members, four upper inner frame vertical members, four upper inner frame corner frame members, each upper inner frame corner member being connectable to two of the upper inner frame longitudinal frame members and to a first end of one of the upper inner frame vertical members.

In some aspects and embodiments, the central frame includes four upper main frame longitudinal frame members, four upper main frame corner frame members, each upper main frame corner frame member including an inner corner frame portion and an outer corner frame portion defining an upper main frame corner recess therebetween, each upper main frame corner member being connectable to a second end of one of the upper outer frame vertical members.

In some aspects and embodiments, the four upper outer frame longitudinal frame members, the four upper outer frame vertical members, the four upper outer frame corner frame members, the four upper inner frame longitudinal frame members, the four upper inner frame vertical members, the four upper inner frame corner frame members, the four upper main frame longitudinal frame members, and the four upper main frame corner frame members connected together to define the configurable frame and wherein the at least one groove includes, first, second, third, fourth and fifth grooves of the first configurable shell.

In some aspects and embodiments, the configurable shell further comprises a first panel sized and configured to be disposed in the first groove, and second, third, fourth and fifth side panels that are sized and configured to be housed in respective second, third, fourth and fifth grooves of the first configurable shell.

In some aspects and embodiments, each upper inner corner member is secured to one of the four outer vertical members.

In some aspects and embodiments, wherein each upper inner corner member includes a post received in a recess defined in one of the four inner vertical members.

In some aspects and embodiments, each inner vertical member is secured to one of the outer vertical members by at least one fastener.

In some aspects and embodiments, the at least one fastener is at least one threaded fastener.

In some aspects and embodiments, each upper outer frame corner member includes at least one post received in a recess defined in a first end one of the upper outer frame vertical members and wherein each upper outer corner member includes a post received in a second recess defined in one of the four outer vertical members.

In some aspects and embodiments, each upper outer frame corner member includes at least a post received in a recess defined in an end one of the upper outer frame horizontal members and each upper inner frame corner member includes at least a second post received in a second recess defined in an end of one of the upper inner frame horizontal members.

In some aspects and embodiments, each upper main frame corner member includes at least one post received in a recess defined in a second end of one of the upper outer frame vertical members, and each upper main frame corner member includes at least one second post received in a recess defined in a second end of one of the upper inner frame vertical members.

In some aspects and embodiments, each upper main frame corner member includes at least a second post received in a recess defined in an end of one of the main frame horizontal members.

In some aspects and embodiments, a length of the four upper outer frame longitudinal frame members, the four upper inner frame longitudinal frame members, and the four main frame longitudinal frame members is configured to define a desired length and width of the first configurable shell.

In some aspects and embodiments, a length of the four upper outer frame vertical members and a length of the four upper inner frame vertical members is configured to define a desired height or depth of the first configurable shell.

In some aspects and embodiments, the first configurable frame is integrally formed. In some aspects and embodiments, the first configurable frame is made of a material comprising metal.

Aspects and embodiments are directed to an article of luggage comprising first and second configurable shells at least one hinge connecting the first configurable shell to the second configurable shell.

Aspects and embodiments of the disclosure are directed to an article of luggage that can be customized for the intended user. Aspects and embodiments of the disclosure are directed to a configurable shell for a configurable article of luggage. Each configurable shell includes a configurable frame structure that can be customized to provide a desired length, width and height (depth) of the configurable shell. Each configurable shell also includes panels including a first panel and side panels that can be customized for the user and inserted into and secured by openings provided by the configurable frame structure. The configurable frame comprises an outer frame subassembly, an inner frame subassembly, and a central frame subassembly. The frame subassemblies and the panels are configurable in length, width, and depth to provide the configurable shell. Two configurable shells can be joined together to provide a configurable article of luggage. The material, stiffness, appearance of the panels can be customized to the user. With this arrangement, the article of luggage can be customized.

According to an aspect of the present disclosure, a first configurable shell for an article of luggage is provided. The first configurable shell comprises an upper outer frame including: four upper outer frame longitudinal frame members; four upper outer frame vertical members; four upper outer frame corner frame members, each upper outer frame corner member being connectable to two of the upper outer frame longitudinal frame members and to a first end of one of the upper outer frame vertical members; an upper inner frame including: four upper inner frame longitudinal frame members; four upper inner frame vertical members: four upper inner frame corner frame members, each upper inner frame corner member being connectable to two of the upper inner frame longitudinal frame members and to a first end of one of the upper inner frame vertical members; the four upper outer frame longitudinal frame members, the four upper outer frame vertical members, the four upper outer frame corner frame members, the four upper inner frame longitudinal frame members, the four upper inner frame vertical members, the four upper inner frame corner frame members, together defining a first configurable frame portion including an inner frame portion and an outer frame portion defining a first opening; and a first panel that is sized and configured to be housed in the first opening of the first configurable shell.

In some embodiments, the shell further comprises a main frame including four upper main frame longitudinal frame members; four upper main frame corner frame members, each upper main frame corner frame member including an inner corner frame portion and an outer corner frame portion defining an upper main frame corner recess therebetween, each upper main frame corner member being connectable to a second end of one of the upper outer frame vertical members; the four upper outer frame longitudinal frame members, the four upper outer frame vertical members, the four upper outer frame corner frame members, the four upper inner frame longitudinal frame members, the four upper inner frame vertical members, the four upper inner frame corner frame members, the four upper main frame longitudinal frame members, and the four upper main frame corner frame members configured be connected together to define a first configurable frame defining second, third, fourth and fifth openings of the first configurable shell; first, second, third and fourth side panels that are sized and configured to be housed in the respective first, second, third and fourth openings of the first configurable shell.

In some embodiments, each upper inner corner member is secured to one of the four outer vertical members.

In some embodiments, each upper inner corner member includes a post received in a recess defined in one of the four inner vertical members.

In some embodiments, each inner vertical member is secured to one of the outer vertical members by at least one fastener.

In some embodiments, the at least one fastener is at least one threaded fastener.

In some embodiments, each upper outer frame corner member includes at least one post received in a recess defined in a first end one of the upper outer frame vertical members.

In some embodiments, each upper outer frame corner member includes at least a post received in a recess defined in an end one of the upper outer frame horizontal members.

In some embodiments, each upper main frame corner member includes at least one post received in a recess defined in a second end of one of the upper outer frame vertical members.

In some embodiments, each upper main frame corner member includes at least a second post received in a recess defined in an end of one of the main frame horizontal members.

In some embodiments, a length of the four upper outer frame longitudinal frame members, the four upper inner frame longitudinal frame members, and the four main frame longitudinal frame members is configured to define a desired length and width of the first configurable shell.

In some embodiments, a length of the four upper outer frame vertical members and a length of the four upper inner frame vertical members is configured to define a desired height or depth of the first configurable shell.

In some embodiments, the first configurable frame is integrally formed.

In some embodiments, the at least one groove includes a first groove defined along at least one of the elongate members of the central frame assembly.

In some embodiments, wherein the first configurable frame is made of a material comprising metal.

In some embodiments, an article of luggage comprises the first configurable shell.

In some embodiments, the article of luggage further comprises a second configurable shell comprising: a bottom outer frame including: four bottom outer frame longitudinal frame members; four bottom outer frame vertical members; four bottom outer frame corner frame members, each bottom frame corner member being connectable to two of the bottom frame longitudinal frame members and to a first end of one of the bottom frame vertical members; a bottom inner frame including: four bottom inner frame longitudinal frame members; four bottom inner frame vertical members: four bottom inner frame corner frame members, each bottom inner frame corner member being connectable to two of the bottom inner frame longitudinal frame members and to a first end of one of the bottom inner frame vertical members; a bottom main frame including four bottom main frame longitudinal frame members; four bottom main frame corner frame members, each bottom main frame corner member being connectable to two of the bottom main frame longitudinal frame members to define an bottom main frame and each bottom main frame corner member being connectable to a second end of one of the bottom outer frame vertical members; the four bottom outer frame longitudinal frame members, the four bottom outer frame vertical members, the four bottom outer frame corner frame members, the four bottom inner frame longitudinal frame members, the four bottom inner frame vertical members, the four bottom inner frame corner frame members, together defining a second configurable frame portion including an inner frame portion and an outer frame portion defining a sixth opening; the four upper bottom frame longitudinal frame members, the four bottom outer frame vertical members, the four bottom outer frame corner frame members, the four bottom inner frame longitudinal frame members, the four bottom inner frame vertical members, the four bottom inner frame corner frame members, the four bottom main frame longitudinal frame members, and the four bottom main frame corner frame members configured to be connected together to define a second configurable frame defining seventh, eighth, ninth and tenth openings of the second configurable shell; a sixth panel that is sized and configured to be housed in the sixth opening of the second configurable shell; seventh, eighth, ninth and tenth side panels that are sized and configured to be housed in the respective seventh, eighth, ninth and tenth openings of the second configurable shell.

In some embodiments, each bottom inner corner member is secured to one of the four outer vertical members.

In some embodiments, each bottom inner corner member includes a post received in a recess defined in one of the four bottom outer vertical members.

In some embodiments, each bottom inner vertical member is secured to one of the bottom outer vertical members by at least one fastener.

In some embodiments, the at least one fastener is at least one threaded fastener.

In some embodiments, each bottom outer frame corner member includes at least one post received in a recess defined in a first end one of the bottom outer frame vertical members.

In some embodiments, each bottom outer frame corner member includes at least a post received in a recess defined in an end one of the bottom frame horizontal members.

In some embodiments, each bottom main frame corner member includes at least one post received in a recess defined in a second end one of the bottom outer frame vertical members.

In some embodiments, each bottom main frame corner member includes at least a second post received in a recess defined in an end of one of the bottom main frame horizontal members.

In some embodiments, a length of the four bottom main outer frame longitudinal frame members, the four bottom main inner frame longitudinal frame members, and the four bottom main frame longitudinal frame members is configured to define a desired length and width of the second configurable shell.

In some embodiments, a length of the four bottom outer frame vertical members and a length of the four bottom inner frame vertical members is configured to define a desired height or depth of the second configurable shell.

In some embodiments, one of the upper main frame and the bottom main frame includes a projection and the other of the upper main frame and the bottom main frame includes a recess so that the upper main frame is configured to mate with the bottom main frame.

In some embodiments, the article of luggage of further comprises a housing size and arranged to fit within the second configurable shell, the housing configured to house an article to be transported.

In some embodiments, the article of luggage further comprises straps connected to the second internal frame within the second configurable shell, the straps configured to secure the article in the housing.

In some embodiments, the article of luggage further comprises a second housing or a lining sized and arranged to fit within the first configurable shell.

In some embodiments, the article of luggage further comprises at least one hinge configured to connect the first configurable shell to the second configurable shell.

In some embodiments, the article of luggage further comprises at least one handle attached to one of the first configurable shell to the second configurable shell.

In some embodiments, the article of luggage further comprises at least one locking structure having a first part attached to the first configurable shell and a second part attached to the second configurable shell to secure the first configurable shell to the second configurable shell.

In some embodiments, the at least one locking structure comprises three locks, a first disposed substantially about a middle of a length of the article of luggage and second and third locks disposed on each side of the first lock.

In some embodiments, the article of luggage further comprises an LED arrangement housed within the article of luggage.

In some embodiments, the article of luggage further comprises a logo defined through the first panel, the LED arrangement illuminating the logo when in an on condition.

Another aspect of the present disclosure relates to a method of assembly an article of luggage. In some embodiments, the method comprises forming a length of the four upper and bottom outer and inner frame longitudinal frame members, and the four upper and bottom inner and outer main frame longitudinal frame members to define a desired length and width of the first configurable shell and the second configurable shell.

Another aspect of the present disclosure relates to a method of assembly of an article of luggage in which the method comprises forming a length of the four upper and bottom outer and inner frame longitudinal frame members to define a desired length and width of the first configurable shell and the second configurable shell.

In some embodiments, the method further comprises forming a length of the four upper inner and outer frame vertical members to define a desired height or depth of the first configurable shell.

In some embodiments, the method further comprises forming a length of the four bottom inner and outer frame vertical members to define a desired height or depth of the second configurable shell.

In some embodiments, the method further comprises forming the height or depth of the first configurable shell to be the same as the height or depth of the second configurable shell.

In some embodiments, forming the four upper and bottom inner and outer frame longitudinal frame members, the four upper and bottom inner and outer frame vertical members, the four upper and bottom main frame longitudinal frame members includes extruding material and then cutting the material to form a desired length of the four upper and bottom inner and outer frame longitudinal frame members, the four upper and bottom inner and outer frame vertical members, the four upper and bottom main frame longitudinal frame members.

Aspects and embodiments of the disclosure are directed to a first configurable shell for an article of luggage. The first configurable shell comprises an upper frame including four upper frame longitudinal frame members, each upper frame longitudinal member including an inner longitudinal frame portion and an outer longitudinal frame portion defining an upper frame longitudinal recess therebetween; four upper frame vertical members, each upper frame vertical member including an inner vertical frame portion and an outer vertical frame portion defining an upper frame vertical recess therebetween; and four upper frame corner frame members, each upper frame corner frame member including an inner corner frame portion and an outer corner frame portion defining an upper frame corner recess therebetween, each upper frame corner member being connectable to two of the upper frame longitudinal frame members and to a first end of one of the upper frame vertical members; a central frame including four upper central frame longitudinal frame members, each upper central frame longitudinal member including an inner longitudinal frame portion and an outer longitudinal frame portion defining an upper central frame longitudinal recess therebetween; four upper central frame corner frame members, each upper central frame corner frame member including an inner corner frame portion and an outer corner frame portion defining an upper central frame corner recess therebetween, each upper central frame corner member being connectable to two of the upper central frame longitudinal frame members to define an upper central frame and each upper central frame corner member and a second end of one of the upper frame vertical members; and the four upper frame longitudinal frame members, the four upper frame vertical members, the four upper frame corner frame members, the four upper central frame longitudinal frame members, and the four upper central frame corner frame members together defining a first configurable frame including an inner frame member and an outer frame member defining first, second, third, fourth and fifth openings; the four upper frame longitudinal frame members and the four upper frame corner frame members configured to be connected together to define the first opening of the first configurable shell; the four upper frame longitudinal frame members, the four upper frame vertical members, the four upper frame corner frame members, the four upper central frame longitudinal frame members, and the four upper central frame corner frame members configured to be connected together to define the second, third, fourth and fifth openings of the first configurable shell; a first panel that is sized and configured to be housed in the first opening of the first configurable shell; first, second, third and fourth side panels that are sized and configured to be housed in the respective first, second, third and fourth openings of the first configurable shell.

In some embodiments, a length of the four upper frame longitudinal frame members, the four upper frame vertical members, and the four central frame longitudinal frame members is configured to define a desired length and width of the first configurable shell.

In some embodiments, a length of the four upper frame vertical members is configured to define a desired height or depth of the first configurable shell.

In some embodiments, each upper frame corner member includes at least one post received in a recess defined in a first end one of the upper frame vertical members.

In some embodiments, each upper frame corner member includes at least a second post received in a recess defined in an end one of the upper frame horizontal members.

In some embodiments, each central frame corner member includes at least one post received in a recess defined in a second end one of the upper frame vertical members.

In some embodiments, each central frame corner member includes at least a second post received in a recess defined in an end of one of the central frame horizontal members.

In some embodiments, a liner secured to the inner frame member of the first configurable shell.

In some embodiments, the first configurable frame is integrally formed.

In some embodiments, the first configurable frame is made of a material comprising metal.

According to another aspect of the present disclosure, an article of luggage is provided comprising the first configurable shell.

In some embodiments, the article of luggage further comprises a second configurable shell comprising, the second configurable shell comprising: a bottom frame including four bottom frame longitudinal frame members, each bottom frame longitudinal member including an inner longitudinal frame portion and an outer longitudinal frame portion defining a bottom frame longitudinal recess therebetween; four bottom frame vertical members, each bottom frame vertical member including an inner vertical frame portion and an outer vertical frame portion defining a bottom frame vertical recess therebetween; four bottom frame corner frame members, each bottom frame corner frame member including an inner corner frame portion and an outer corner frame portion defining a bottom frame corner recess therebetween, each bottom frame corner member being connectable to two of the bottom frame longitudinal frame members and to a first end of one of the bottom frame vertical members; a bottom central frame including four bottom central frame longitudinal frame members, each bottom central frame longitudinal member including an inner longitudinal frame portion and an outer longitudinal frame portion defining a central frame longitudinal recess therebetween; four bottom central frame corner frame members, each bottom central frame corner frame member including an inner corner frame portion and an outer corner frame portion defining an central frame corner recess therebetween, each bottom central frame corner member being connectable to two of the bottom central frame longitudinal frame members to define a bottom central frame and each bottom central frame corner member being connectable to a second end of one of the bottom frame vertical members; and the four bottom frame longitudinal frame members, the four bottom frame vertical members, the four bottom frame corner frame members, the four bottom central frame longitudinal frame members, and the four bottom central frame corner frame members together defining a second configurable frame including a second inner frame portion and an outer frame portion defining sixth, x openings; the four bottom frame longitudinal frame members and the four bottom frame corner frame members configured to be connected together to define the sixth opening of the first configurable shell; the four bottom frame longitudinal frame members, the four bottom frame vertical members, the four bottom frame corner frame members, the four bottom central frame longitudinal frame members, and the four bottom central frame corner frame members configured to be connected together to define the seventh, eighth, ninth and tenth openings of the second configurable shell; a sixth panel that is sized and configured to be housed in the sixth opening of the first configurable shell; seventh, eighth, ninth and tenth side panels that are sized and configured to be housed in the respective seventh, eighth, ninth and tenth openings of the second configurable shell.

In some embodiments, one the upper central frame and the bottom central frame includes a projection and the other of the upper central frame and the bottom central frame includes a recess so that the upper central frame is configured to mate with the bottom central frame.

In some embodiments, the luggage further comprises a housing size and arranged to fit within the second configurable shell, the housing configured to house an article to be transported.

In some embodiments, the luggage further comprises straps connected to the second frame within the second configurable shell, the straps configured to secure the article in the housing.

In some embodiments, the luggage further comprises a housing or a lining sized and arranged to fit within the first configurable shell.

In some embodiments, the luggage further comprises at least one hinge configured to connect the first configurable shell to the second configurable shell.

In some embodiments, the luggage further comprises at least one handle attached to one of the first configurable shell to the second configurable shell.

In some embodiments, the luggage further comprises at least one locking structure having a first part attached to the first configurable shell and a second part attached to the second configurable shell to secure the first configurable shell to the second configurable shell.

In some embodiments, the at least one locking structure comprises three locks, a first disposed substantially about a middle of a length of the article of luggage and second and third locks disposed on each side of the first lock.

In some embodiments, the article of luggage further comprises an LED arrangement housed within the article of luggage.

In some embodiments, the article of luggage further comprises a logo defined through the first panel, the LED arrangement illuminating the logo when in an on condition.

According to another aspect of the present disclosure, a method of assembling the article of luggage comprises forming a length of the four upper and bottom frame longitudinal frame members, the four upper and bottom frame vertical members, and the four upper and bottom central frame longitudinal frame members to define a desired length and width of the first configurable shell.

In some embodiments, the method comprises forming a length of the four upper frame vertical members is configured to define a desired height or depth of the first configurable shell.

In some embodiments, the method further comprises forming a length of the four bottom frame vertical members to define a desired height or depth of the second configurable shell.

In some embodiments, the method further comprises forming the height or depth of the first configurable shell to be the same as the height or depth of the second configurable shell.

In some embodiments, forming the four upper and bottom frame longitudinal frame members, the four upper and bottom frame vertical members, the four upper and bottom central frame longitudinal frame members includes extruding material and then cutting the material to form a desired length of the four upper and bottom frame longitudinal frame members, the four upper and bottom frame vertical members, the four upper and bottom central frame longitudinal frame members.

According to another aspect of the present disclosure, a shell for a luggage, shell comprises a top panel and four side panels; an outer corner frame and an inner corner frame that are secured together about the top panel and the four side panels; the outer corner frame including four outer longitudinal frame members; four outer vertical members; and four outer corner frame members, each corner frame member being connectable to two of the outer longitudinal frame members and one of the outer vertical members; the inner corner frame including four inner longitudinal frame members;

four inner vertical members; and four inner corner frame members, each corner frame member being connectable to two of the inner longitudinal frame members and one of the outer vertical members; and an opening of the shell defined by four rail corner members secured to one of the outer corner frame; and four longitudinally extending rails members, each rail secured to two of the rail corner members.

In some embodiments, each rail corner member is secured to one of the four outer vertical members.

In some embodiments, each rail corner member includes a post received in a recess defined in one of the four outer vertical members.

In some embodiments, each inner vertical member is secured to one of the outer vertical members by at least one fastener.

In some embodiments, the at least one fastener is at least one threaded fastener.

In some embodiments, the shell further comprises a liner secured to one of the inner corner frame or the opening of the shell.

In some embodiments, each inner corner member is integrally formed and each outer corner member is integrally formed.

In some embodiments, each inner corner member is made of a material comprising metal and each outer corner member is made of a material comprising metal.

According to another aspect of the present disclosure, an article of luggage comprises the shell.

In some embodiments, the article of luggage further comprises a second shell.

According to another aspect of the present disclosure, a method of assembling a shell for an article of luggage is provided. The method comprises forming the four outer longitudinal frame members, the four outer vertical members, the four inner longitudinal frame members, the four inner vertical members, and the four longitudinally extending rail members in the desired lengths.

In some embodiments, forming the four outer longitudinal frame members, the four outer vertical members, the four inner longitudinal frame members, and the four inner vertical members includes extruding material and then cutting the material to form the four outer longitudinal frame members, the four outer vertical members, the four inner longitudinal frame members, and the four inner vertical members. According to another aspect of the present disclosure, a luggage case shell comprises a configurable frame assembly comprising an outer frame subassembly, an inner frame subassembly, and a central frame subassembly; wherein the outer frame subassembly and inner frame subassembly include corner pieces and elongate elements, the corner pieces and elongate members of the outer frame subassembly and the inner frame subassembly together define a portion of at least one groove; wherein the central frame assembly includes elongate members and corner members common to both the inner and outer frame assemblies and connected to them so as to form a remainder of the at least one groove defined by the outer frame subassembly, the inner frame subassembly, and the central frame subassembly; and a first rigid panel disposed in the at least one groove.

In some embodiments, the elongate members of the configurable frame assembly are configurable in length so as to provide the configurable frame assembly that is configurable in length, width, and depth.

In some embodiments, the inner and outer frame subassemblies are configured to connect together at the corners.

In some embodiments, the at least one groove comprises, a first groove and four additional grooves.

In some embodiments, the first rigid panel is disposed in the first groove and four additional rigid side panels are disposed in the four additional grooves to comprise the configurable shell.

In some embodiments, the outer frame subassembly includes: four upper outer frame longitudinal frame members; four upper outer frame vertical members; and four upper outer frame corner frame members, each upper outer frame corner member being connectable to two of the upper outer frame longitudinal frame members and to a first end of one of the upper outer frame vertical members; and the inner frame subassembly includes: four upper inner frame longitudinal frame members; four upper inner frame vertical members; and four upper inner frame corner frame members, each upper inner frame corner member being connectable to two of the upper inner frame longitudinal frame members and to a first end of one of the upper inner frame vertical members.

In some embodiments, the central frame includes: four upper main frame longitudinal frame members; and four upper main frame corner frame members, each upper main frame corner frame member including an inner corner frame portion and an outer corner frame portion defining an upper main frame corner recess therebetween, each upper main frame corner member being connectable to a second end of one of the upper outer frame vertical members; the four upper outer frame longitudinal frame members, the four upper outer frame vertical members, the four upper outer frame corner frame members, the four upper inner frame longitudinal frame members, the four upper inner frame vertical members, the four upper inner frame corner frame members, the four upper main frame longitudinal frame members, and the four upper main frame corner frame members connected together to define the configurable frame and wherein the at least one groove includes, first, second, third, fourth and fifth grooves of a first configurable shell.

In some embodiments, the first rigid panel is sized and configured to be disposed in the first groove, and further comprising second, third, fourth and fifth rigid side panels that are sized and configured to be housed in respective second, third, fourth and fifth grooves of the first configurable shell.

In some embodiments, each upper inner corner member is secured to one of the four outer vertical members.

In some embodiments, each upper inner corner member includes a post received in a recess defined in one of the four inner vertical members.

In some embodiments, each inner vertical member is secured to one of the outer vertical members by at least one fastener.

In some embodiments, each upper outer frame corner member includes at least one post received in a recess defined in a first end one of the upper outer frame vertical members.

In some embodiments, each upper outer frame corner member includes at least a post received in a recess defined in an end one of the upper outer frame horizontal members.

In some embodiments, each upper main frame corner member includes at least one post received in a recess defined in a second end of one of the upper outer frame vertical members.

In some embodiments, each upper main frame corner member includes at least a second post received in a recess defined in an end of one of the main frame horizontal members.

In some embodiments, a length of the four upper outer frame longitudinal frame members, the four upper inner frame longitudinal frame members, and the four main frame longitudinal frame members is configurable to define a desired length and width of a first configurable shell.

In some embodiments, a length of the four upper outer frame vertical members and a length of the four upper inner frame vertical members is configurable to define a desired height or depth of a first configurable shell.

In some embodiments, an article of luggage comprises a first luggage case shell comprising the luggage case shell; a second luggage case shell comprising the luggage case shell; and at least one hinge connecting the first luggage case shell to the second luggage case shell.

In some embodiments, the article of luggage further comprises wheels and a handle.

In some embodiments, the article of luggage further comprises an LED lighting arrangement housed within the at least the first luggage case shell of the article of luggage.

In some embodiments, the article of luggage further comprises a logo defined through the first rigid panel, the LED lighting arrangement illuminating the logo when in an on condition.

BRIEF DESCRIPTION OF THE DRAWINGS

Various aspects of at least one example are discussed below with reference to the accompanying figures. Where technical features in the figures or detailed description are followed by reference signs, the reference signs have been included for the sole purpose of increasing the intelligibility of the figures or detailed description. Accordingly, neither the reference signs nor their absence are intended to have any limiting effect on the scope of any claim elements. In the figures, each identical or nearly identical component that is illustrated in various figures is represented by a like numeral. For purposes of clarity, not every component may be labeled in every figure. The figures are provided for the purposes of illustration and explanation and are not intended as a definition of the limits of the disclosure. In the figures:

LIST OF REFERENCE NUMBERS

Figure 1A:
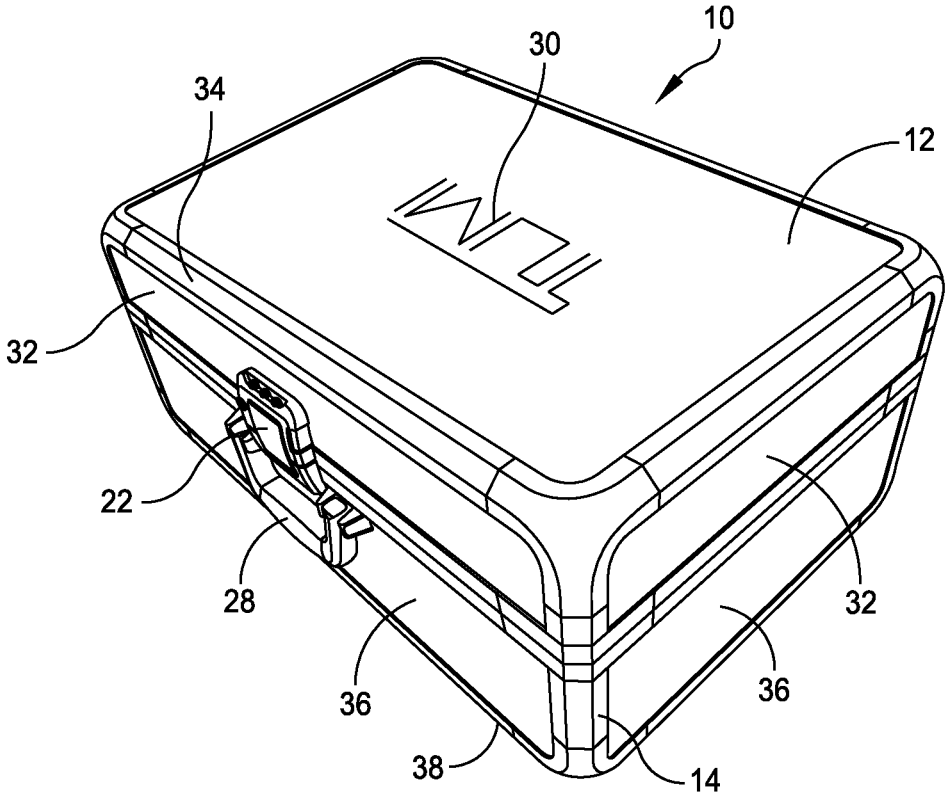
FIG. 1A is a perspective view of an embodiment of luggage of the present disclosure in a closed condition.

Reference number 10 refers to a modular luggage 10 in an open configuration.
Reference number 12 refers to a first shell;
Reference number 14 refers to a second shell;
Reference number 16 refers to hinges;
Reference number 16A refers to a hinge;
Reference number 18 refers to hinged brackets;
Reference number 20 refers to an internal compartment of the luggage;
Reference number 22 refers to latches;
Reference number 24 refers to an item within the luggage;
Reference number 26 refers to a support within the internal compartment of the luggage;
Reference number 28 refers to a handle of the luggage;
Reference number 30 refers to a top panel;
Reference number 31 refers to a bottom panel;
Reference number 32 refers to side panels;
Reference number 34 refers to a first frame;
Reference number 36 refers to side panels;
Reference number 38 refers to a second frame;
Reference number 50 refers to a first central frame subassembly;
Reference number 52 refers to an upper frame subassembly;
Reference number 54 refers to an outer frame portion of the upper frame subassembly;
Reference number 56 refers to an inner frame portion of the upper frame subassembly;
Reference number 58 refers to rail corner members of the first central frame subassembly;
Reference number 60 refers to longitudinally extending rail members;
Reference number 62 refers to a body of the rail corner member 58;
Reference number 64 refers to a vertical post of the rail corner member;
Reference number 65 refers to a second vertical post;

Reference number 66 refers to a laterally extending post of the rail corner member;
Reference number 68 refers to flanges;
Reference number 70 refers to a seat;
Reference number 72 refers to flanges;
Reference number 74 refers to a seat;
Reference number 80 refers to a body of the longitudinally extending rail member;
Reference number 82 refers to a lip;
Reference number 84 refers to flanges;
Reference number 86 refers to a seat;
Reference number 88 refers to a recess;
Reference number 90 refers to an outer corner frame member;
Reference number 92 refers to a longitudinal frame member;
Reference number 94 refers to an outer vertical member;
Reference number 96 refers to a body of the outer corner frame member;
Reference number 98 refers to a lateral post;
Reference number 100 refers to a vertical post 100;
Reference number 101 refers to a fastener;
Reference number 102 refers to a frame member;
Reference number 104 refers to a body of the frame member 102;
Reference number 106 refers to a recess;
Reference number 110 refers to an inner corner frame member;
Reference number 112 refers to a longitudinal frame member;
Reference number 114 refers to an outer vertical frame member;
Reference number 116 refers to a body of the inner corner frame member;
Reference number 118 refers to a lateral post;
Reference number 120 refers to a vertical post;
Reference number 122 refers to a frame member;
Reference number 124 refers to a body of the frame member 122;
Reference number 126 refers to a recess;
Reference number 130 refers to a second central frame subassembly;
Reference number 132 refers to a lower frame subassembly;
Reference number 134 refers to an outer frame portion;
Reference number 136 refers to an inner frame portion;
Reference number 138 refers to a rail corner member;
Reference number 140 refers to a longitudinally extending rail member;
Reference number 142 refers to a body of the rail corner member 138;
Reference number 143 refers to a lip;
Reference number 144 refers to a vertical post;
Reference number 145 refers to a second vertical post;
Reference number 146 refers to a laterally extending post;
Reference number 148 refers to a flange;
Reference number 150 refers to a seat;
Reference number 152 refers to a flange;
Reference number 154 refers to a seat;
Reference number 160 refers to a body of the longitudinally extending rail member 140;
Reference number 162 refers to a recess;
Reference number 164 refers to a flange;
Reference number 166 refers to a seat;
Reference number 168 refers to a recess;
Reference number 170 refers to an article of luggage;
Reference number 180 refers to lights;
Reference number 190 refers to an article of luggage;
Reference number 192 refers to a latch;
Reference number 194 refers to an illuminated feature;
Reference number 196 refers to a handle;
Reference number 198 refers to a hinge; and
Reference number 200 refers to a foot.

DETAILED DESCRIPTION

The disclosure is directed to a configurable shell for a configurable article of luggage. The configurable shell comprises a first panel and four side panels, an outer frame subassembly, an inner frame subassembly, and a central frame subassembly. The frame subassemblies define a configurable frame. The frame and the panels are configurable in length, width, and depth to provide a configurable shell. Two configurable shells can be joined together to provide a configurable article of luggage.

Aspects and embodiments of the disclosure are directed to configurable shell for an article of luggage, comprising a configurable frame assembly comprising an outer frame subassembly, an inner frame subassembly, and a central frame subassembly. The outer frame assembly and inner frame assembly include corner pieces and elongate elements. The corner pieces and elongate members of the outer frame assembly and inner frame assembly together define a portion of at least one groove. The configurable shell further includes a central frame assembly that includes elongate members and corner members common to both inner and outer frame members and connected to the inner and outer frame members so as to form a remainder of the at least one groove defined by the outer frame subassembly, the inner frame subassembly, and the central frame subassembly.

Aspects and embodiments of the disclosure are directed to an article of luggage that can be customized for the intended user. Aspects and embodiments of the disclosure are directed to a configurable shell for a configurable article of luggage. Each configurable shell includes a configurable frame structure that can be customized to provide a desired length, width and height (depth) of the configurable shell. Each configurable shell also includes panels including a first panel and side panels that can be customized for the user and inserted into and secured by openings provided by the configurable frame structure. The configurable frame also comprises an outer frame subassembly, an inner frame subassembly, and a central frame subassembly. The frame subassemblies and the panels are configurable in length, width, and depth to provide the configurable shell. Two configurable shells can be joined together to provide a configurable article of luggage. The material, stiffness, appearance of the panels can be customized to the user. With this arrangement, the article of luggage can be customized. Reference will now be made in detail to representative examples illustrated in the accompanying drawings. It should be understood that the following descriptions are not intended to limit the examples to one preferred implementation of the disclosure. To the contrary, it is intended to cover alternatives, modifications, and equivalents as may be included within the spirit and scope of the described examples as defined by the appended claims.

Figure 1B:
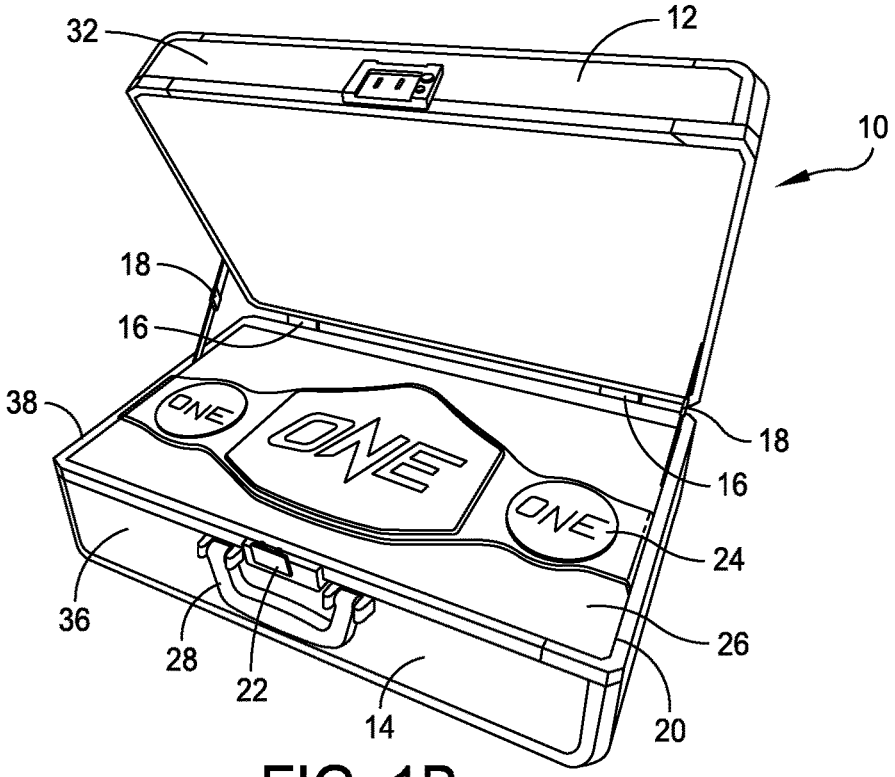
FIG. 1B is another perspective view thereof in an open condition.
Figure 1C:
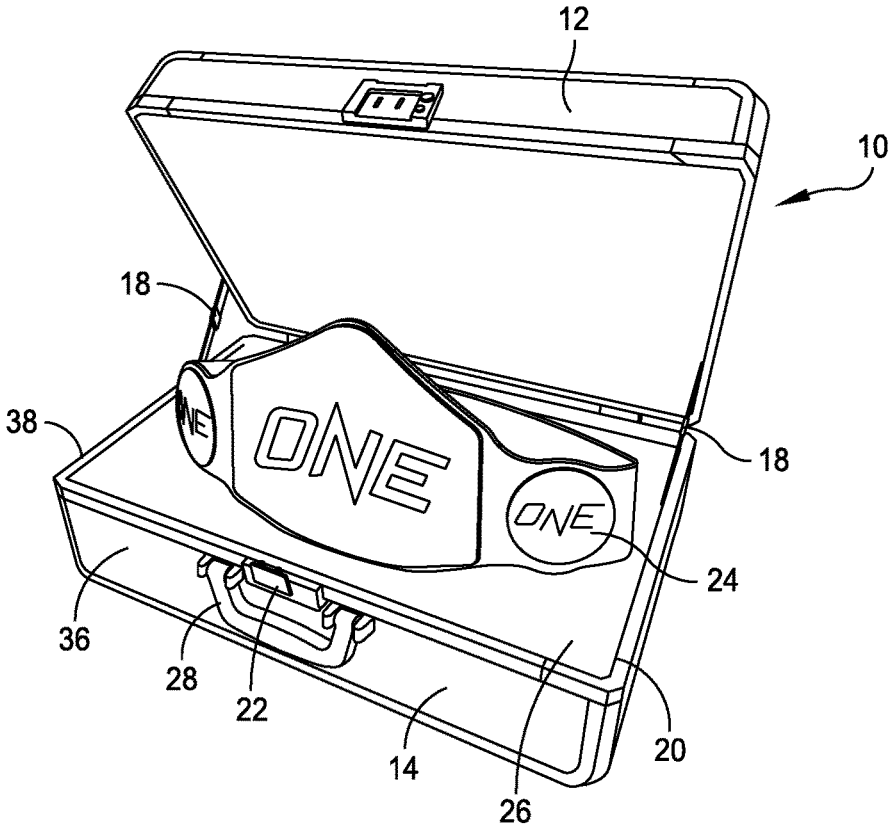
FIG. 1C is another perspective view thereof with an item being displayed within the inner compartment of the open luggage.

FIGS. 1A, 1B, and 1C illustrate a fully constructed modular article of luggage 10 according to one example of the present disclosure. FIG. 1A shows a perspective view of the modular article of luggage 10 in a closed configuration. FIGS. 1B and 1C show the modular article of luggage 10 in an open configuration. The article of luggage 10 includes a first shell 12 and a second shell 14. The first shell 12 and the second shell 14 are secured together, such as for example by a hinge on one side of the first and second shells, so as to be rotatable with respect to each other about a hinged sides.

Each of the first shell and the second shell includes a frame that supports panels. The frame and the panels may be configured in any size. The panels may be cut from sheets of stock material to the desired size. The frame may be assembled from components, some of which may be cut from stock material to a desired size.

The frame of the first shell 12 includes a first (upper) central (main) frame subassembly and an upper frame assembly extending upwardly from (connected to) the first central frame subassembly. The frame of the second shell 14 includes a second central (main) frame subassembly and a lower (bottom) frame subassembly. The first central frame subassembly of the first shell 12 and the second central frame subassembly of the second shell 14 may be joined by one or more hinges along one side of the frame assemblies so that together the first and second central frame subassemblies define the hinged opening of the article of luggage.

In some embodiments, the upper frame subassembly and the lower frame subassembly are formed of like parts having at least substantially identical dimensions.

Figure 14A:
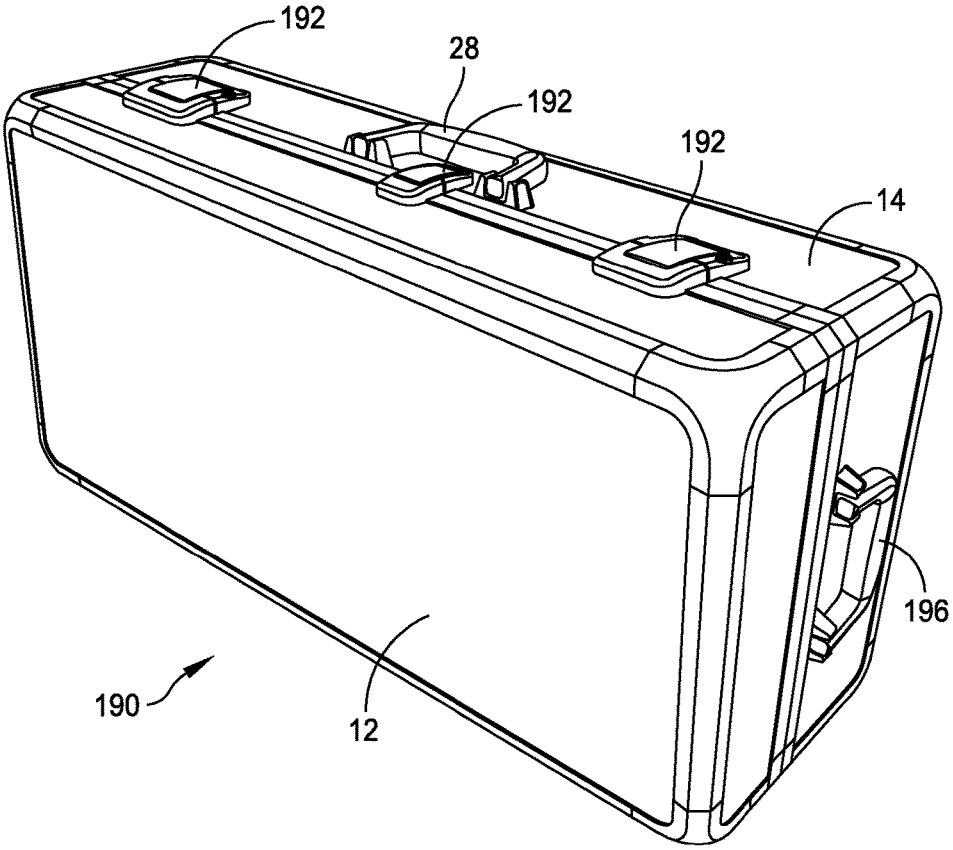
FIG. 14A is a perspective view of another embodiment of an article of luggage.
Figure 14B:
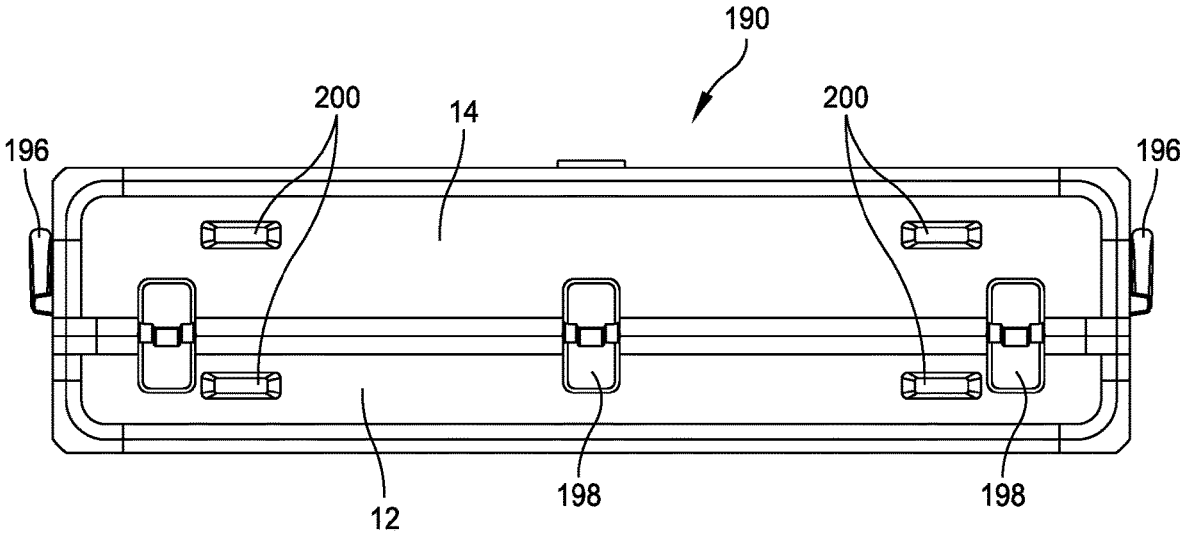
FIG. 14B is a bottom view of the article of luggage of FIG. 14A.

The first shell and the second shell may be connected by one or more hinges. In some embodiments, a single hinge connects the first shell and the second shell along one side of the central frame subassemblies. In some embodiments, a plurality of hinges connect the first shell and the second shell along one side of the central frame subassemblies. The plurality of hinges can be two or more hinges (for example three hinges, as shown in FIG. 14B). As shown in FIG. 1B, the first shell 12 and the second shell 14 are connected by two hinges 16. The first shell 12 and the second shell 14 may include hinge brackets 18 connected to the first shell and second shell. The hinged brackets 18 support the first shell 12 in a fixed orientation with respect to the second shell 14 in FIG. 1B. With this arrangement, the first shell 12 and the second shell 14 can be locked in the open configuration as illustrated in FIGS. 1B and 1C by the two hinged brackets 18.

The first shell 12 and the second shell 14 together define an internal compartment 20. The internal compartment 20 may be opened and closed by rotating the first shell 12 relative to the second shell 14 so the luggage 10 is in the configuration of FIG. 1A-1C. One or more latches 22 on the luggage 10 secure the first shell 12 in a closed orientation relative to the second shell 14. FIG. 14A shows a perspective view of one embodiment of an article of luggage 190 including a first shell 12 and a second shell 14 that are identical to the first shell 12 and second shell 14 of the luggage 10, that includes three latches 192. The latches 192 are spaced apart along an edge of the opening between the first shell 12 and second shell 14 to allow a user to selectively secure the opening of the luggage 190 in a closed condition. In some embodiments, the first shell 12 and the second shell 14 are securable by one or more latches that can include one latch, two latches, three latches, or a plurality of latches. Referring to FIGS. 14A-14B, in some embodiments a central latch 192 is disposed near handle 28 (FIGS. 1A-1C) and second and third latches 192 are disposed on each side of the central latch 192, which is similar to latch 22. In some embodiments, the first shell and the second shell are securable by a plurality of latches that are not all the same size as each other. Aspects and embodiments include a central latch that is smaller than the second and third latches. In the embodiment of FIGS. 14A-14B, the luggage 190 also includes two side handles 196 in addition to the central handle 28. The embodiment of luggage 190 of FIGS. 14A-14B also includes and four feet 200 that can support the luggage 190 on a support surface, such as the ground. The feet 200 may be made of rubber and/or another material.

Referring to FIGS. 1B-1C, the inner compartment 20 of the second configurable shell 14 can includes a support or holder 26. As illustrated in FIG. 1B, an item 24 to be transported within the luggage 10 is secured in the holder. As illustrated in FIG. 1C, the item 24 can be propped up vertically and displayed on the support 26 within the inner compartment 20 of the luggage 10.

In some embodiments, the luggage 10 may include one or more handles 28 on the exterior or the first shell 12 and/or the second shell 14. FIGS. 1A through 1C show a handle 28 secured to the second shell 14.

The article of luggage 10 may optionally further include one or preferably a plurality of wheels secured to the first shell 12 and/or the second shell 14, such as two wheels secured to each of the first shell and the second shell, to facilitate support and movement of the luggage 10 by a user. As noted herein, the article of luggage can include one or more handles as disclosed according to aspects and embodiments disclosed herein. It is appreciated that the handle can any handle known to one of skill in the art including handles as disclosed herein and other handles including telescoping handles. It is appreciated that according to aspects and embodiments, the configurable article of luggage can be any size (as desired) and can include wheels and one or more handles including a telescoping handle that facilitates pushing and/or pulling of the article of luggage.

The first configurable shell 12 and the second configurable shell 14 each are formed from configurable frames that support customizable panels. As shown in FIG. 1A, the first shell 12 includes a top panel 30 and four side panels 32 that are supported by a first configurable frame 34. The second shell 14 includes a bottom panel (not illustrated) and four side panels 36 that are supported by a second configurable frame 38.

The top panel 30, the bottom panel, and the side panels 32, 36 each include two opposing surfaces that are at least substantially flat and configured to form a portion of an exterior surface of the respective shell and an interior surface of the respective shell.

For example, the panels of the first shell 12 and the second shell 14 may be hard panels. The panels may be formed a of a hard plastic material such as polyvinyl chloride (PVC), polyethylene (PE), polypropylene (PP), carbon fiber, or Tegris® polypropylene moldable fabric manufactured by Milliken (available at http://www.milliken.com/MFT). However, a person having ordinary skill in the art will recognize that any suitable fabric, plastic, metal, or any other suitable material having a high stiffness-to-weight ratio and high impact resistance may be used. The panels of the first shell and the second shell may also be formed by any suitable means for forming hard shells for luggage, including thermoforming a sheet of hard plastic material onto a mold for the luggage shell, vacuum forming, compression molding, injection molding, or blow molding.

In a preferred example, the panels of the first shell and the second shell may be formed of material that includes a woven polypropylene thermoplastic composite having a plurality of layers, such as Tegris® polypropylene moldable fabric. For example, the first shell the second shell may include six layers of the woven polypropylene thermoplastic composite, or any other suitable number of layers. In some examples, the panels of the first shell and the second shell may be coated with a surface coating, and the surface coating can be, for example, a polyester film, or any other suitable material.

The frames and panels of the first shell and the second shell may also be constructed with any desired dimensions so long as the length and width dimensions of the first shell and the second shell match or at least substantially match, such that first shell and the second shell join to form a single piece of hard shell luggage, as shown for example in FIGS. 1A, 1B, and 1C. No particular dimensions are required. It is an object of the present disclosure to provide an easily adaptable article of hard shell luggage and a method of manufacture of differing dimensions and sizes using a single set of components that are easily adapted to provide an article of hard shell luggage of varying sizes and dimensions. However, in some examples, the depth of the first shell may be less or greater than that of the second shell. In other examples, the dimensions of the first shell may be identical or substantially identical to those of the second shell.

Figure 2:
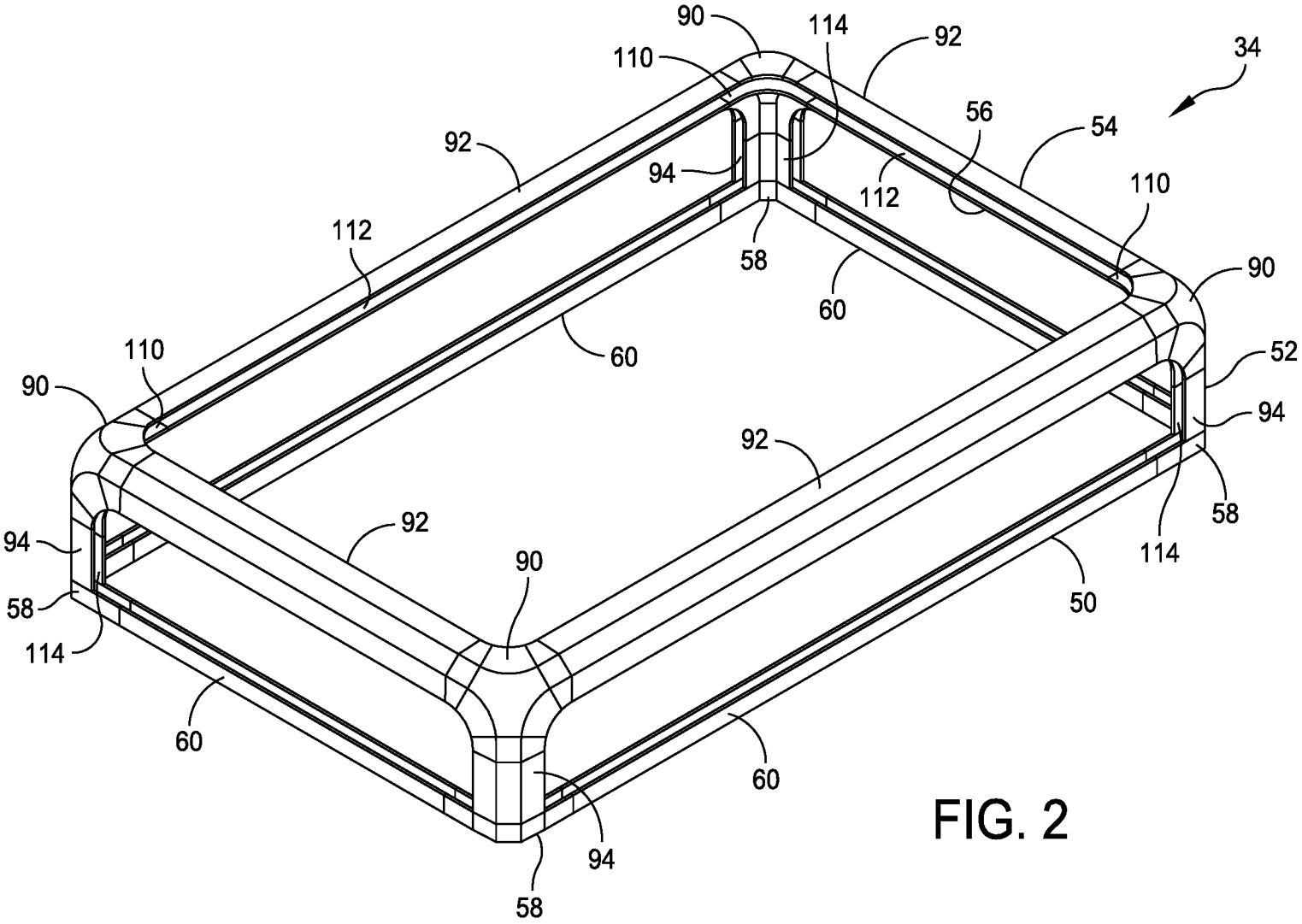
FIG. 2 is a perspective view of a frame of a first shell of the luggage.

FIG. 2 shows a perspective view of the first configurable upper frame assembly 34. The first (upper) configurable frame assembly 34 includes a first central (main) frame subassembly 50 and an upper frame subassembly 52. Aspects and embodiments of the upper frame subassembly 52 include an outer frame portion 54 and an inner frame portion 56. The outer frame portion 54 and the inner frame portion 56 are secured together so as to provide a frame portion around the panels 30, 32. The upper frame subassembly and the central frame subassembly together provide first (top), second (side), third (side), fourth (side), and fifth (side) openings in which respective first (top), second (side), third (side), fourth (side), and fifth (side) panels can be held in the upper frame assembly to secure the top panel 30 to the four side panels 32 in fixed spatial relation relative to each other.

The first central (main) frame subassembly 50 includes four central rail corner members 58 and four longitudinally extending rail members 60 that are secured together. Each central rail corner member 58 is secured to two adjacent longitudinally extending rail members 60. Each rail corner member 58 is configured to be secured to an outer corner frame of the upper frame subassembly. As shown in FIG. 4G, each central rail corner member 58 includes a body 62 and a vertical post 64 extending upwardly from the body 62. The vertical post 64 is configured to be received in a recess in the upper frame subassembly. Each central rail corner member 58 also includes two laterally extending posts 66 configured to be received in a recess in an adjacent one of the longitudinally extending rail members 60.

As shown in FIG. 4G, to support a corner of one of the panels of the shell, a first pair of flanges 68 extend upwardly from the body 62 of the rail corner member 58, and a first seat 70 extends between the upwardly extending flanges 68 for engaging an edge and corner of the respective panel. To support a corner of another one of the panels of the shell, a second pair of flanges 72 extend upwardly from the body 62 of the rail corner member 58, and a second seat 74 extends between the upwardly extending flanges 72 for engaging an edge and corner of the respective panel.

Figure 4A:
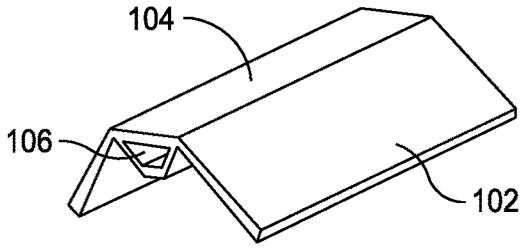
FIG. 4A-4H are perspective views of components of the frames of FIGS. 2 and 3.
Figure 4E:
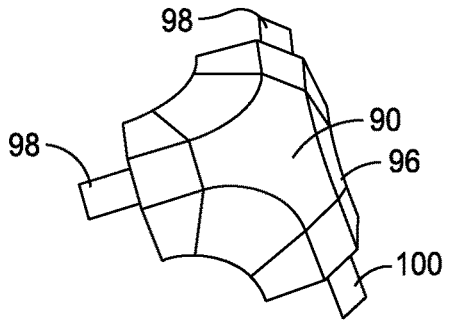
Figure 4B:
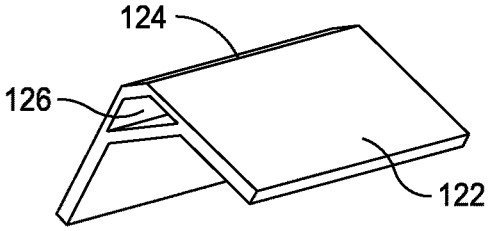
Figure 4F:
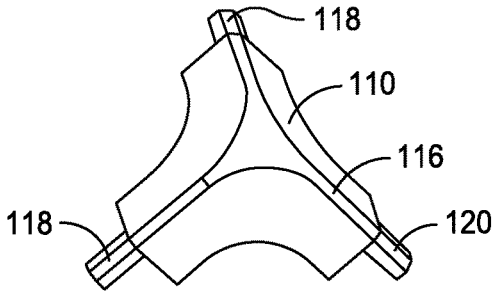
Figure 4C:
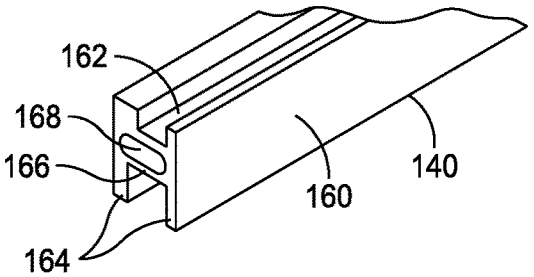
Figure 4G:
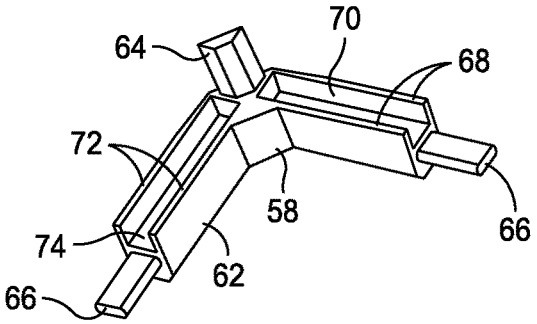
Figure 4D:
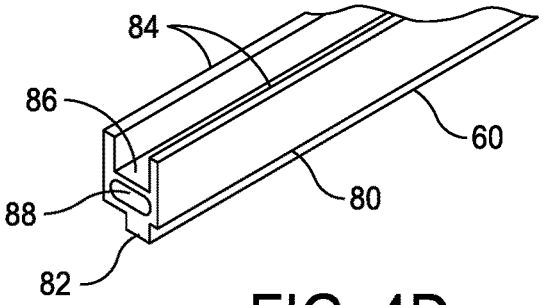

As shown in FIG. 4D, each longitudinally extending central (main) rail member 60 includes a body 80 having a lower lip 82 configured to engage a longitudinally extending rail member of the central (main) frame of the second shell. In addition, to support a side of one of the panels of the shell, a first pair of flanges 84 extend upwardly from the body 80 of the longitudinally extending rail member 60, and a seat 86 extends between the upwardly extending flanges 84 for engaging a longitudinal edge of the respective panel.

Each longitudinally extending rail member 60 includes a recess 88 defined on each end of the longitudinally extending rail member 60 for receiving one of the laterally extending posts 66 of the adjacent rail corner member 58 (See FIG. 4G).

Referring to FIG. 2, as mentioned above, the upper frame subassembly 52 includes an inner frame portion 56 and an outer frame portion 54. The outer corner frame portion 54 includes for outer corner frame members 90, four outer longitudinal frame members 92 and four outer vertical members 94.

Each outer corner frame member 90 is connectable to two of the outer longitudinal frame members 92 and one of the outer vertical members 94. Referring to FIG. 4E, the outer frame corner member 90 includes a body 96 with lateral posts 98 extending from the body 96 and configured to be received in a recess of an adjacent one of the longitudinal frame members 92. The outer corner frame member 90 also includes a vertical post 100 extending from the body 96 and configured to be received in a recess defined in one of the vertical members 94.

Each outer corner frame member 90 may be integrally formed. In some embodiments, each outer corner frame member 90 is formed by a suitable manufacturing method, such as casting, three-dimensional (3D) printing, or another manufacturing method.

Referring to FIG. 4A, each of the longitudinally extending frame member 92 and vertical members 94 have a frame member 102 having a body 104 and a recess 106 defined in and extending along the length of the body 104. At each end of the frame member 102, recess 106 is configured to receive one of the posts 98, 100 of the corner member 90.

Each longitudinally extending frame member 92 and vertical member 94 may be formed by any suitable means. In some embodiments, each longitudinally extending frame member 92 and each vertical member 94 is formed by extrusion. Each longitudinally extending frame member 92 and each vertical member 94 may be cut to a desired length to provide desired length, width and depth dimension of the respective frame for the configurable shell of the article of luggage.

Referring to FIG. 2, the inner corner frame portion 56 includes for inner corner frame members 110, four inner longitudinal frame members 112 and four inner vertical members 114.

Each inner corner frame member 110 is connectable to two of the inner longitudinal frame members 112 and one of the outer vertical members 114. Referring to FIG. 4F, the inner corner frame member 110 includes a body 116 with lateral posts 118 extending from the body 116 and configured to be received in a recess of an adjacent one of the longitudinal frame members 112. The inner corner frame member 110 includes a vertical post 120 extending from the body 116 and configured to be received in a recess defined in one of the vertical members 114.

Each inner corner frame member 110 may be integrally formed. In some embodiments, each inner corner frame member 110 is formed by a suitable manufacturing method, such as casting, three-dimensional (3D) printing, or another manufacturing method.

Referring to FIG. 4B, each of the inner longitudinally extending frame members 112 and inner vertical members 114 is formed from a frame member 122 having a body 124 and a recess 126 defined in and extending along the length of the body 124. At each end of the frame member 112, recess 126 is configured to receive one of the posts 118, 120 (See FIG. 4F) of the corner member 110.

Each longitudinally extending inner frame member 112 and inner vertical member 114 may be formed by any suitable means. In some embodiments, each longitudinally extending frame member 112 and each vertical frame member 114 is formed by extrusion. Each longitudinally extending frame member 112 and each vertical frame member 114 may be cut to a desired length to provide desired length, width and depth dimension of the respective configurable frame for the configurable shell of the article of luggage.

Figure 3:
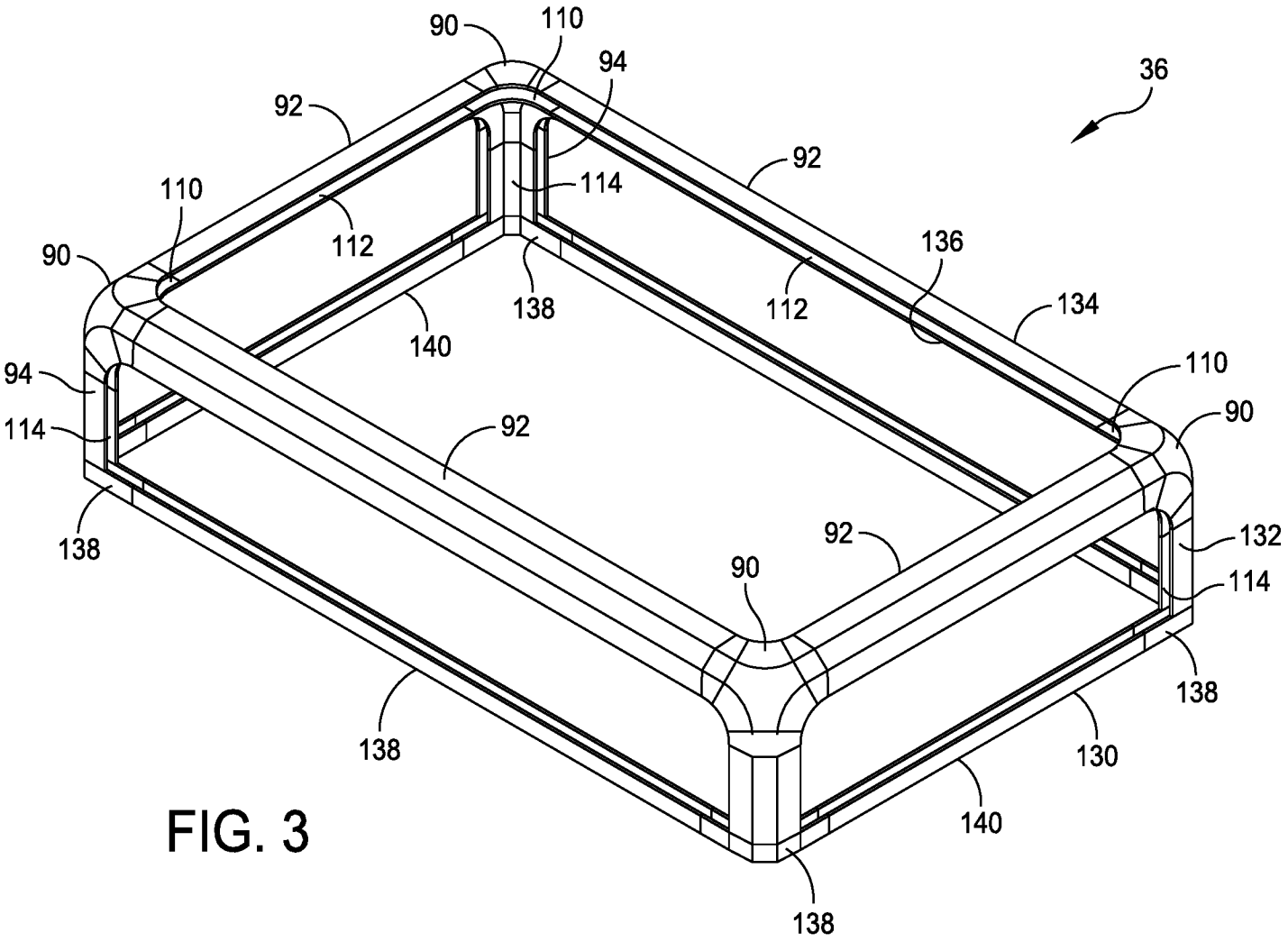
FIG. 3 is a perspective view of a frame of a second shell of the luggage.

FIG. 3 shows a perspective view of the second (bottom) frame assembly 36. The second frame assembly is constructed from some of the same components as the first frame assembly described above. The second frame 36 subassembly includes a second central (main) frame subassembly 130 and a lower frame subassembly 132. The lower frame subassembly 132 includes an outer frame portion 134 and an inner frame portion 136. The outer frame portion 134 and the inner frame portion 136 are secured together. The second (bottom) frame subassembly and the bottom central (main) frame subassembly together provide sixth (bottom), seventh (side), eighth (side), ninth (side), and tenth (side) openings in which respective sixth (bottom), seventh (side), eighth (side), ninth (side), and tenth (side) panels can be held in the lower frame assembly. The outer frame portion 134 and the inner frame portion 136 are secured together so as to provide a frame portion that secures the panels to secure the bottom panel to the four side panels 36 in fixed spatial relation relative to each other.

Figure 4H:
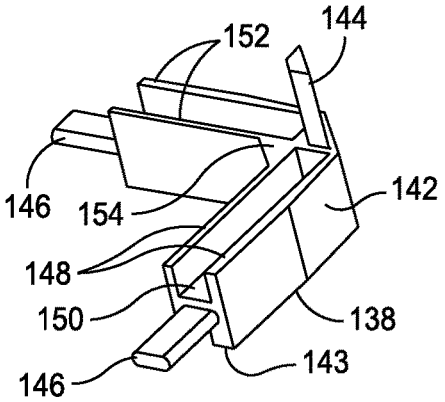

The second central (main) frame subassembly 130 includes four rail (central) corner members 138 and four longitudinally extending rail (central) members 140. Each rail corner member 138 is configured to be secured to an outer corner frame of the lower frame subassembly. Referring to FIG. 4H, each rail corner member 138 includes a body 142 and a vertical post 144 extending downwardly from the body 142. The vertical post 144 is configured to be received in a recess in the lower frame subassembly. Each rail corner member 138 also includes a laterally extending post 146 configured to be received in a recess in an adjacent one of the longitudinally extending rail members 140. Each rail (main) corner member 138 includes a lip 143 configured to be received in a recess in the central (main) rail corner member 58 so as to mater respective central (main) frames together.

Referring to FIG. 4H, to support a corner and portion of an edge of one of the panels of the second configurable shell, a first pair of flanges 148 extend upwardly from the body 142 of the rail corner member 138, and a first seat 150 extends between the upwardly extending flanges 148 for engaging a corner and a portion of an edge of the respective panel. To support another one of the panels of the shell, a second pair of flanges 152 extend upwardly from the body 142 of the rail corner member 138, and a second seat 154 extends between the upwardly extending flanges 152 for engaging a corner and portion of an edge of the respective panel.

Referring to FIG. 4C, each longitudinally extending central (main) rail member 140 includes a body 160 having a lower recess 162 configured to receive the lip 82 a longitudinally extending rail member 60 of the central (main) frame of the first shell so as to mate the first central frame to the second central frame. To support an edge of one of the panels of the second shell, a first pair of flanges 164 extend upwardly from the body 160 of the longitudinally extending rail member 140, and a seat 166 extends between the downwardly extending flanges 164 for engaging an edge of the respective panel.

Each longitudinally extending rail member 140 includes a recess 168 defined on each end of the longitudinally extending rail member 140 for receiving one of the laterally extending posts 146 of the adjacent rail corner member 138.

Referring again to FIG. 3, as mentioned above, the lower frame subassembly 132 includes the inner frame portion 134 and the outer frame portion 136.

The outer corner frame portion 134 includes four outer corner frame members 90, four outer longitudinal frame members 92 and four outer vertical members 94.

Each outer corner frame member 90 is connectable to two of the outer longitudinal frame members 92 and one of the outer vertical members 94. Referring to FIG. 4E, the outer frame corner member 90 includes a body 96 with lateral posts 98 extending from the body 96 and configured to be received in a recess of an adjacent one of the longitudinal frame members 92. The outer corner frame member 90 includes a vertical post 100 extending from the body 96 and configured to be received in a recess defined in one of the vertical members 94.

Referring to FIG. 4A, each of the longitudinally extending frame member 92 and vertical members 94 have a frame member 102 having a body 104 and a recess 106 defined in and extending along the length of the body 104. At each end of the frame member 102, the recess 106 is configured to receive one of the posts 98, 100 of the corner member 90.

Each longitudinally extending frame member 92 and vertical member 94 may be formed by any suitable means. In some embodiments, each longitudinally extending frame member 92 and each vertical member 94 is formed by extrusion. Each longitudinally extending frame member 92 and each vertical member 94 may be cut to a desired length to provide desired dimension of the respective frame for the shell of the luggage.

Referring to FIG. 3, the inner corner frame portion 136 includes for inner corner frame members 110, four outer longitudinal frame members 112 and four outer vertical members 114. Each inner corner frame member 110 is connectable to two of the inner longitudinal frame members 112 and one of the outer vertical members 114. In the embodiment of FIG. 4F, the inner corner frame member 110 includes a body 116 with lateral posts 118 extending from the body 116 and configured to be received in a recess of an adjacent one of the longitudinal frame members 112. The inner corner frame member 110 includes a vertical post 120 extending from the body 116 and configured to be received in a recess defined in one of the vertical members 114.

Referring to FIG. 4G each of the longitudinally extending frame member 112 and vertical member 114 is formed from a frame member 122 having a body 124 and a recess 126 defined in and extending along the length of the body 124. At each end of the frame member 112, the recess 126 is configured to receive one of the posts 118, 120 of the corner member 110.

Each longitudinally extending frame member 112 and vertical member 114 may be formed by any suitable means. In some embodiments, each longitudinally extending frame member 112 and each vertical member 114 is formed by extrusion. Each longitudinally extending frame member 112 and each vertical member 114 may be cut to a desired length to provide desired dimension of the respective frame assembly for the second (bottom) configurable shell of the article of luggage.

According to aspects and embodiments of the article of luggage, by using the above enumerated modular components, a configurable frame may be formed by joining the modular components together.

Prior to assembling the article of luggage, a user specifies the desired length, width, and height of the article of luggage. The user then cuts lengths of material, such as extruded material, to form the longitudinal frame members 92, 112 and the vertical frame members 94, 114 having appropriate lengths based on the desired length, width, and height of the fully assembled luggage.

Figure 5A:
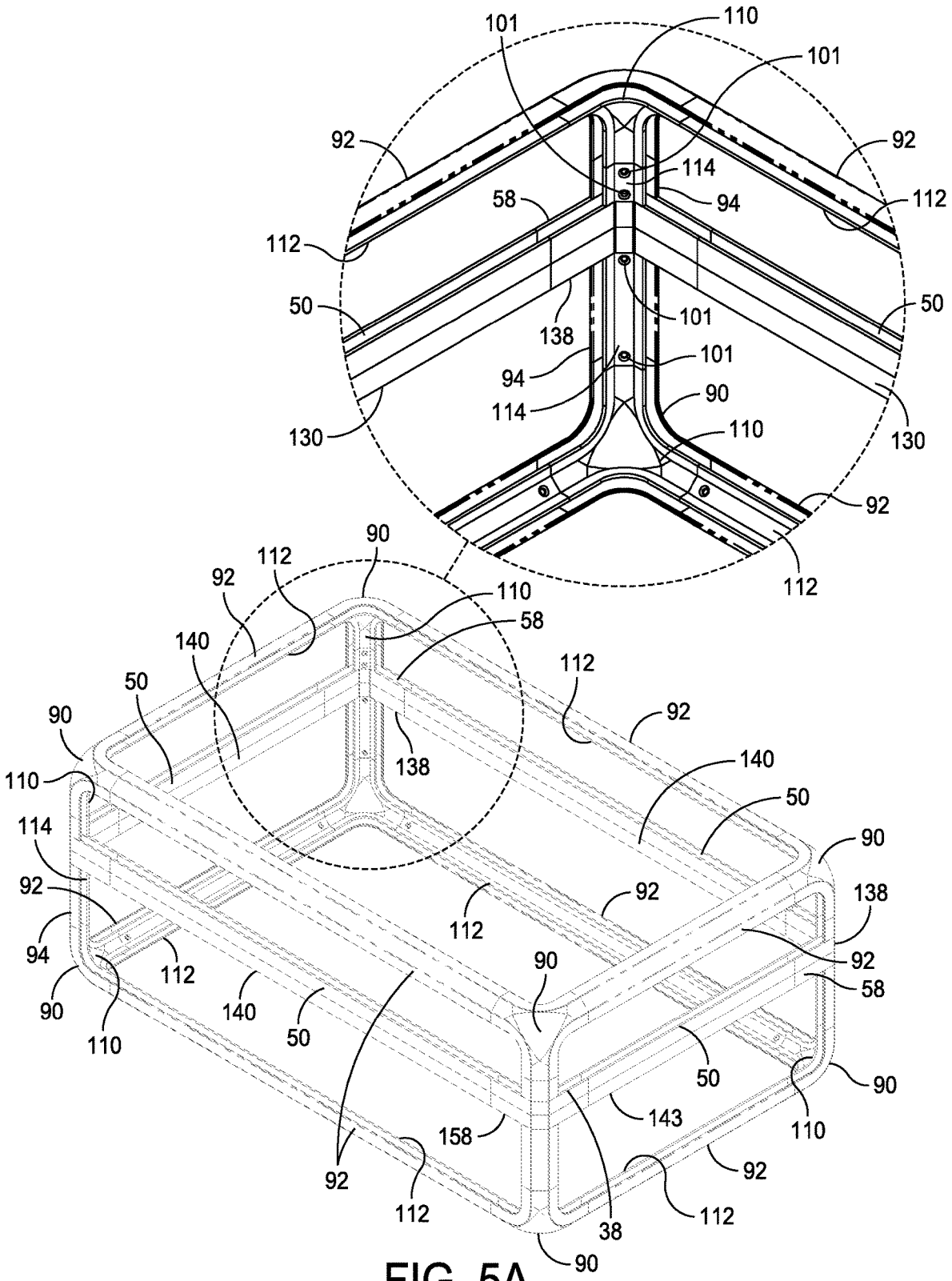
FIG. 5A is a perspective view of an embodiment of luggage of the present disclosure without the panels of the luggage shown.
Figure 5B:
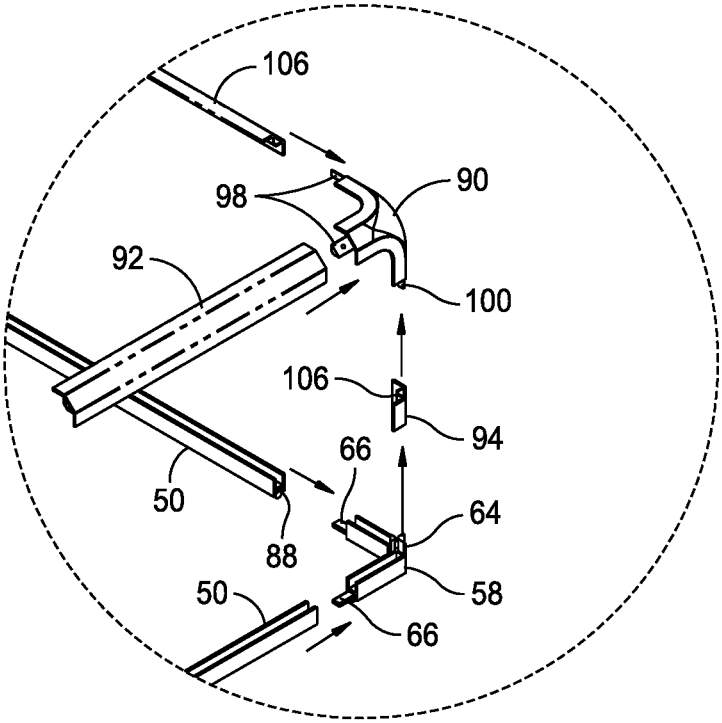
FIG. 5B is an exploded view thereof.
Figure 5C:
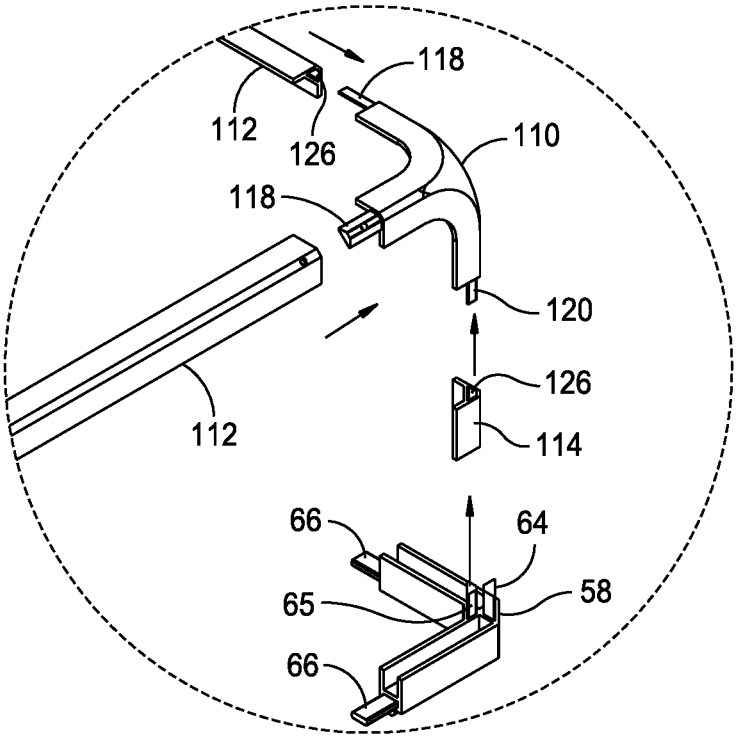
FIG. 5C is another exploded view thereof.

FIG. 5A shows the assembled first (upper) frame and second (bottom) frame of the configurable article of luggage before panels have been added to and secured in the frame. It is appreciated that like reference numbers for like parts have been used and are not necessarily discussed again with respect to the fully assembled view. The exploded view of FIG. 5B shows how the components of the first (upper) outer frame is assembled. FIG. 5C is an exploded view of how the components interconnect for the upper inner frame subassembly.

For each outer corner member 90, the user inserts the posts 98 of the outer corner member into the recesses 106 in the segments of material forming the adjacent longitudinal frame members 92 and secures the posts with at least one fastener 101, such as a threaded fastener, that extends through the longitudinal frame member 92 into the respective post 98. A user inserts the post 100 of the outer corner member into the recess 106 in the segment of material forming the adjacent vertical frame members 94 and secures the post with at least one fastener (not illustrated), such as a threaded fastener, that extends through the vertical frame member 94 into the post 100.

The user seats the panels against the inner surfaces of the longitudinal members 92 and then assembles the inner frame portion to secure the panels between the outer frame portion and the inner frame portion.

For each inner corner member 110, the user inserts the posts 118 of the inner corner member into the recesses 126 in the segments of material forming the adjacent longitudinal frame members 112 and secures the posts with at least one fastener (not illustrated), such as a threaded fastener, that extends through the longitudinal frame member 112 into the respective post 118. A user inserts the post 120 of the outer corner member into the recess 126 in the segment of material forming the adjacent vertical frame members 114 and secures the post with at least one fastener (not illustrated), such as a threaded fastener, that extends through the vertical frame member 114 into the post 120.

The above steps may be performed to assemble the upper and lower frame subassemblies. The upper frame assembly may then be secured to the first central frame subassembly to provide the first (upper) configurable frame assembly (shell) and the lower frame assembly may then be secured to the second central frame assembly to provide the second (bottom) configurable frame assembly (shell).

To secure the upper frame assembly to the first central (main) frame subassembly, the user secures the posts 66 of the corner rail member 58 into the adjacent longitudinal rail members 60 to form the central frame of the first shell. Then the user inserts at least one fastener, such as a threaded fastener, through the longitudinal rail member 60 into the respective post 66 of the corner rail member 58. Then the user inserts the vertical post 64 of the corner member 58 into the recess 106 of the outer vertical member 102 of the upper frame assembly and places at least one fastener, such as a threaded fastener, through the inner vertical frame member 114 and the outer vertical frame member 94 and the vertical post 64.

To secure the lower frame assembly to the second central frame subassembly, the user secures the posts 146 of the corner rail member 142 into the adjacent longitudinal rail members 140 to form the central frame of the second shell. Then the user inserts at least one fastener, such as a threaded fastener, through the longitudinal rail member 140 into the respective post 146 of the corner rail member 142. Then the user inserts the vertical post 144 of the corner member 142 into the recess 106 of the outer vertical member 102 of the lower frame assembly and places at least one fastener, such as a threaded fastener, through the inner vertical frame member 114 and the outer vertical frame member 94 and the vertical post 144.

The user may then secure at least one hinge to one side of the first and second central (main) frame assemblies and components of at least one latch to a second side of the first and second central (main) frame assemblies.

Figure 6:
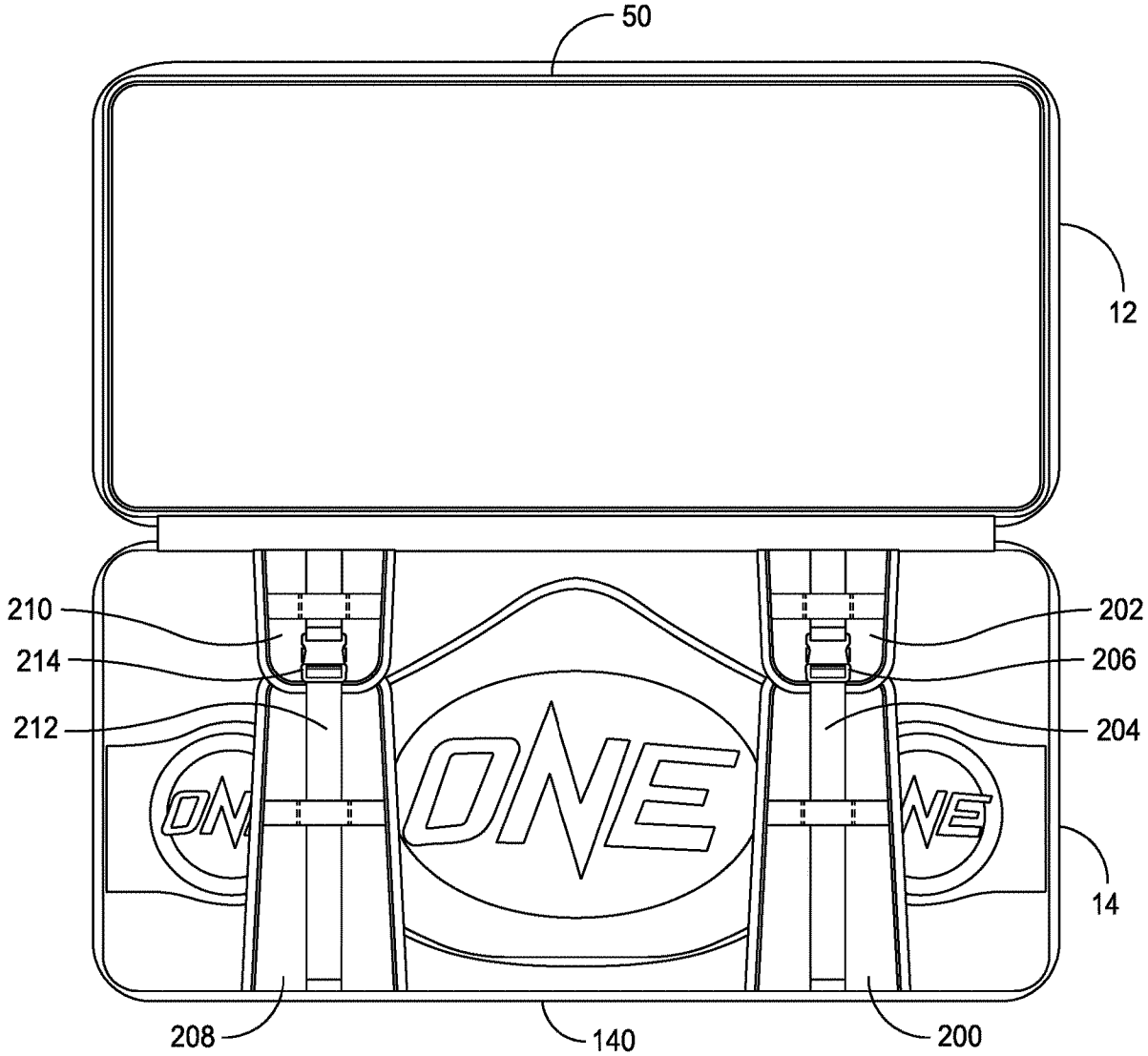
FIG. 6 is a top view of an embodiment of luggage of the present disclosure in an open condition.

FIG. 6 illustrates a fully assembled embodiment of an article of luggage according to the present disclosure. This embodiment that has like features as those described above, and additionally includes protective wings to secure an item to be transported, such as a valuable item, within the configurable article of luggage. A first pair of a protective wings 200, 202 are secured to the second configurable frame 140 of the second shell 14. The protective wings 200, 202 may be fastened together by a strap 204 including a clasp 206 to secure the valuable item within the luggage. Similarly, A second pair of a protective wings 208, 210 are secured to the second frame 140 of the second shell 14. The protective wings 208, 210 may be fastened together by a strap 212 including a clasp 214 to secure the valuable item within the luggage. As noted above with respect to FIGS. 1B-1C, the inner compartment 20 of the second configurable shell 14 can includes a support or holder 26. As illustrated in FIG. 1B, an item 24 to be transported within the luggage 10 is secured in the holder. As illustrated in FIG. 1C, the wings or straps can be released and an item 24 can be propped up vertically and displayed on the support 26 within the inner compartment 20 of the luggage 10. In addition, as illustrated in FIG. 6, the first (upper configurable) shell can also include a liner or other material disposed within the first configurable shell.

Referring to FIGS. 7-11, exemplary views and dimensions of the various components of the configurable outer, inner, and central (main) frames are illustrated. It is appreciated that the illustrated dimensions are by way of example only, and some or all of the dimensions can be varied to, for example, accommodate differing length, width and depth dimensions of the configurable article of luggage.

Figure 7:
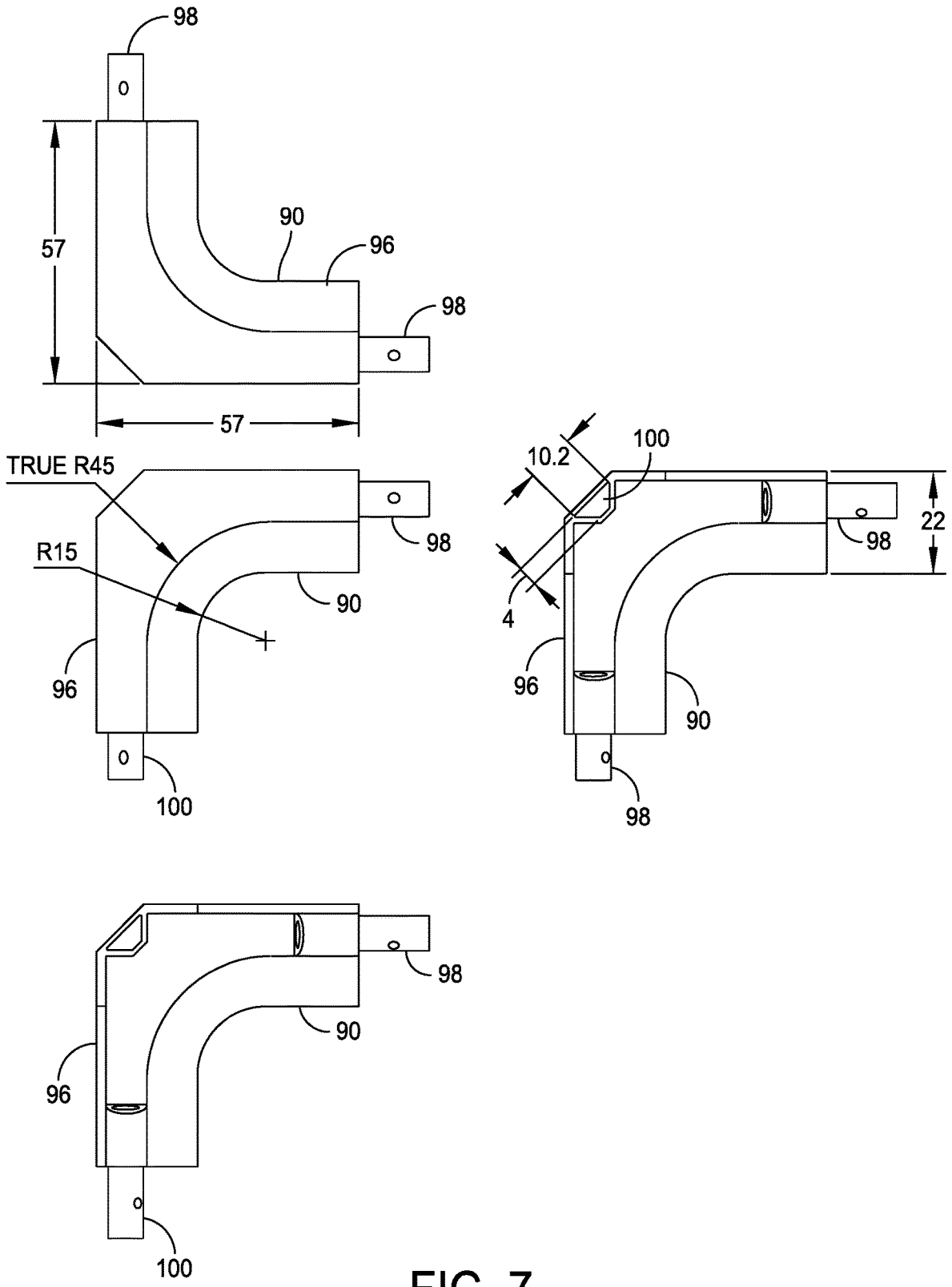
FIG. 7-10C are views of various components of the configurable frame and shell detailing exemplary dimensions of the components forming a luggage of the present disclosure.

FIG. 7 shows exemplary dimensions of an embodiment of an outer corner frame member 90 for use in the upper frame assembly or the lower frame assembly.

Figure 8:
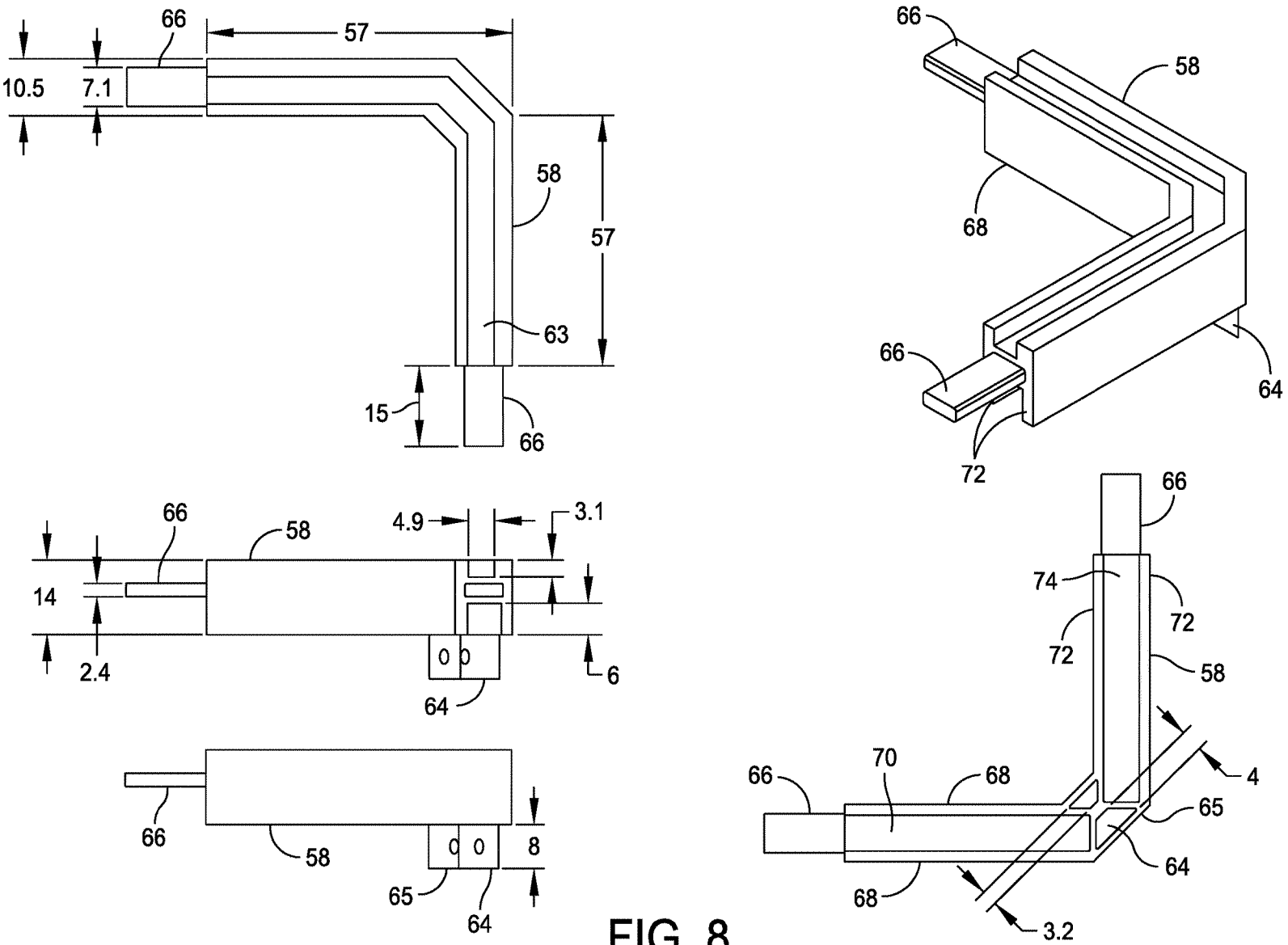

FIG. 8 shows exemplary dimensions of an embodiment of a central (main) rail corner member 58A for use in the first central frame subassembly 50. The central rail corner member 58A is identical to the central rail corner member 58, a second vertical post 65 configured to be received in the recess of an inner vertical member. FIG. 8 shows a recess 63 configured to receive the lip 143 of the central rail corner member 138A.

Figure 9:
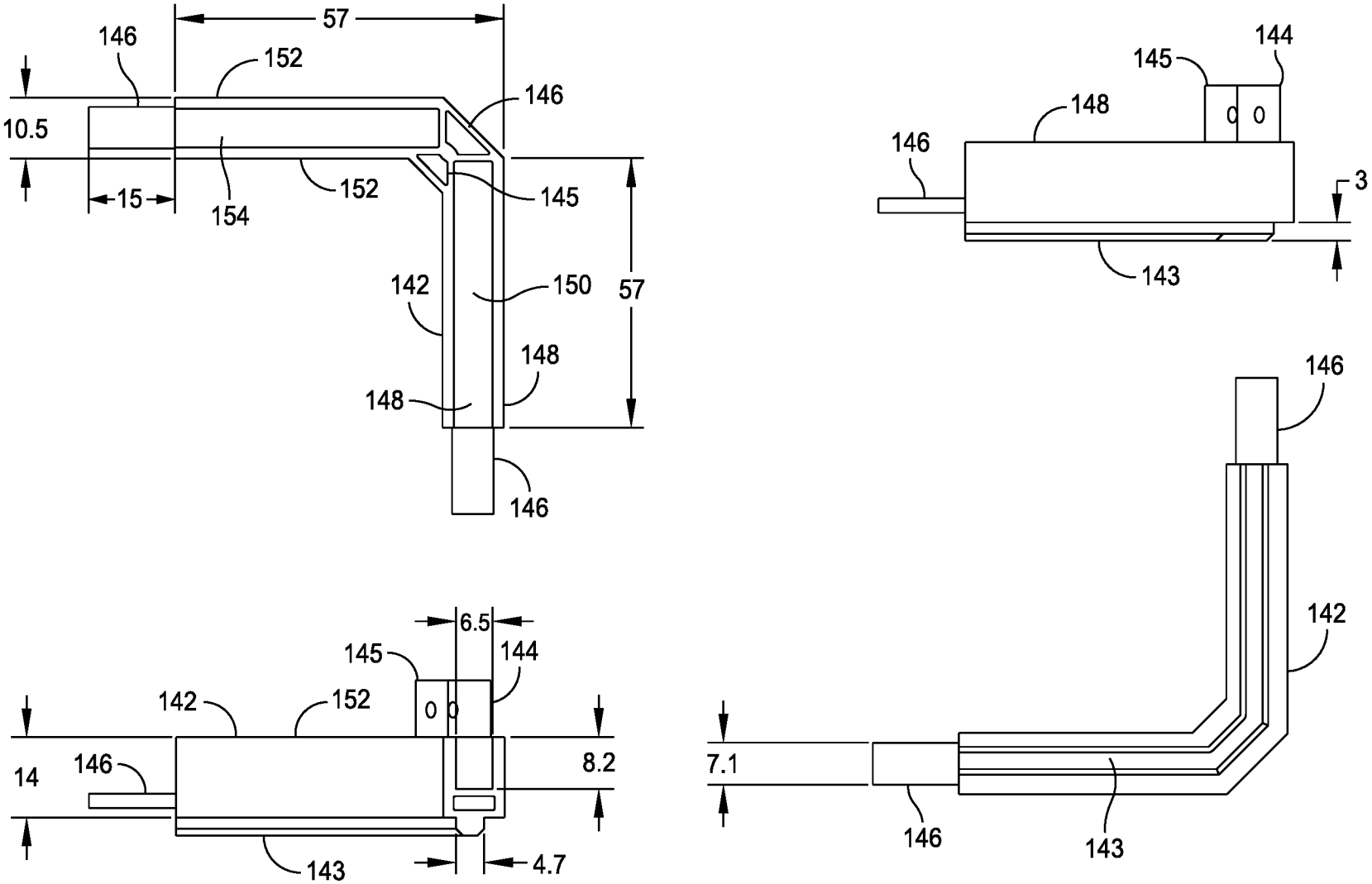

FIG. 9 shows exemplary dimensions of an embodiment of a central rail corner member 138A for use in the first central frame subassembly 130. The central rail corner member 138A is identical to the central rail corner member 138, except it further includes a second vertical post 145 configured to be received in the recess of an inner vertical member.

Figure 10A:
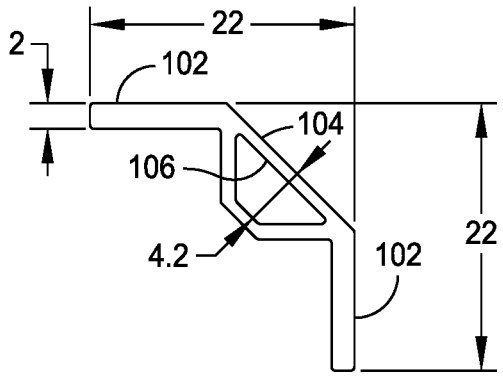

FIG. 10A shows exemplary dimensions of an embodiment of an outer longitudinal frame member.

Figure 10B:
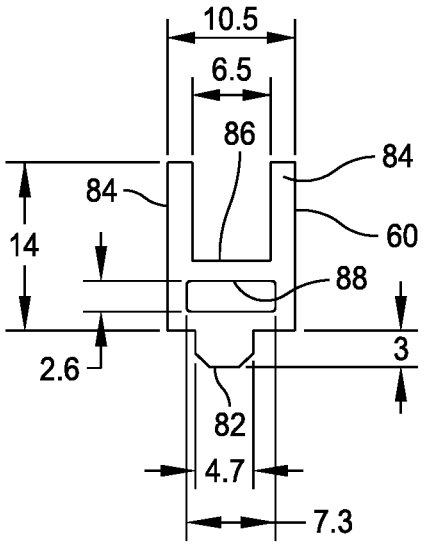

FIG. 10B shows exemplary dimensions of an embodiment of a longitudinally extending rail member 60.

Figure 10C:
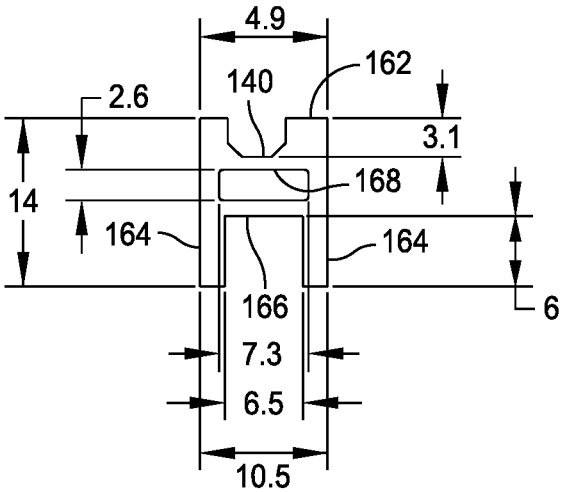

FIG. 10C shows exemplary dimensions of an embodiment of a longitudinally extending rail member 140.

Figure 11:
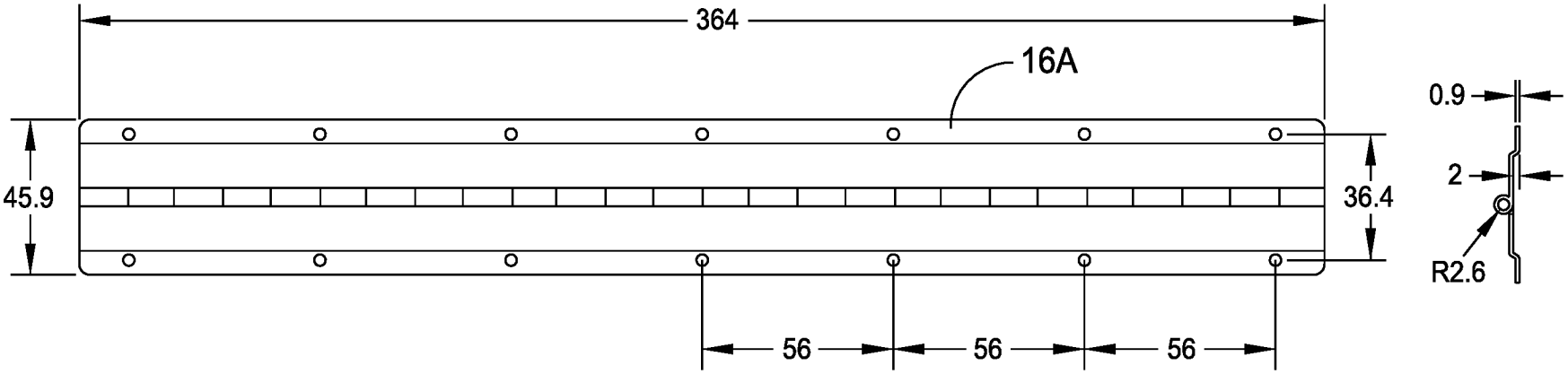
FIG. 11 is an exemplary hinge for forming a luggage of the present disclosure.
Figure 12A:
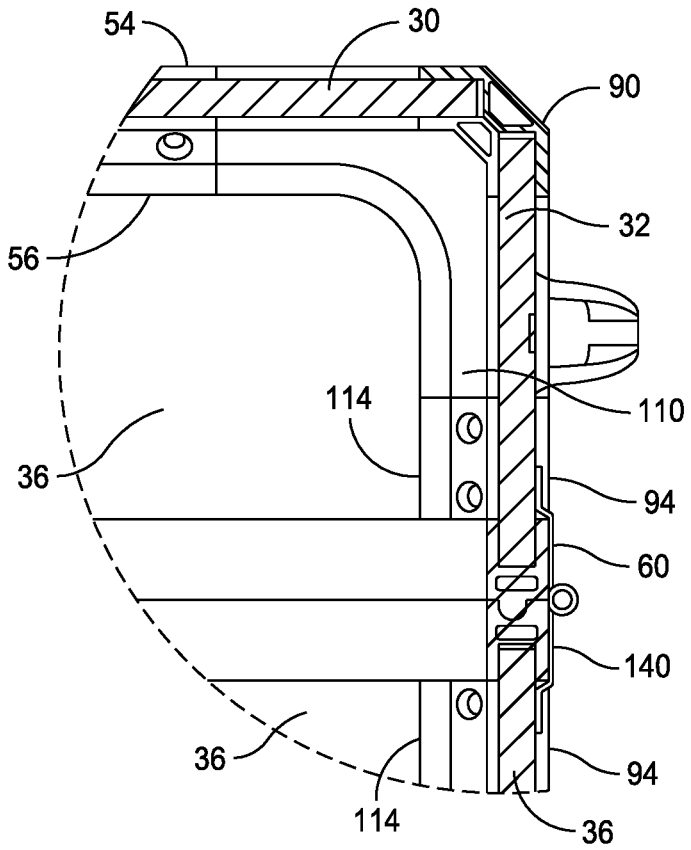
FIGS. 12A-12F is a set of views of an embodiment of a luggage of the present disclosure.
Figure 12B:
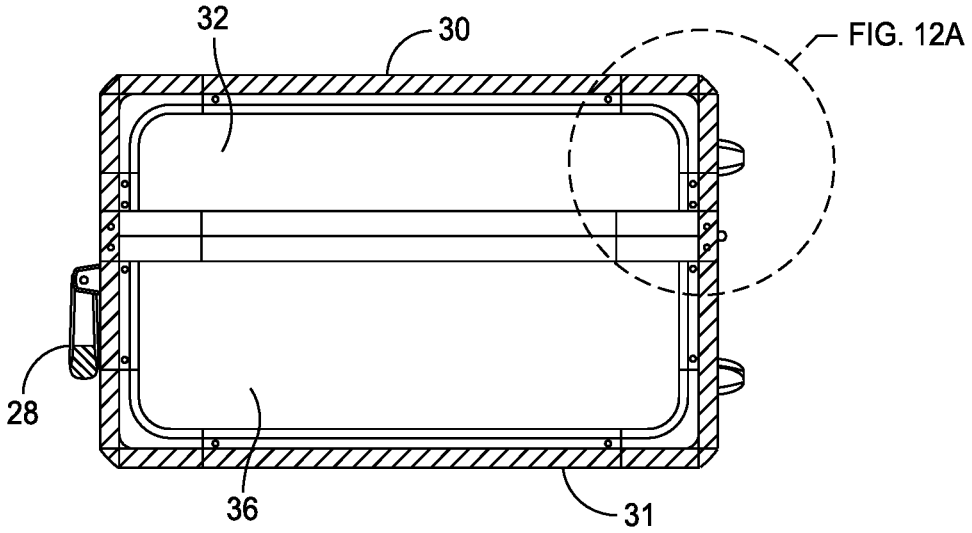
Figure 12C:
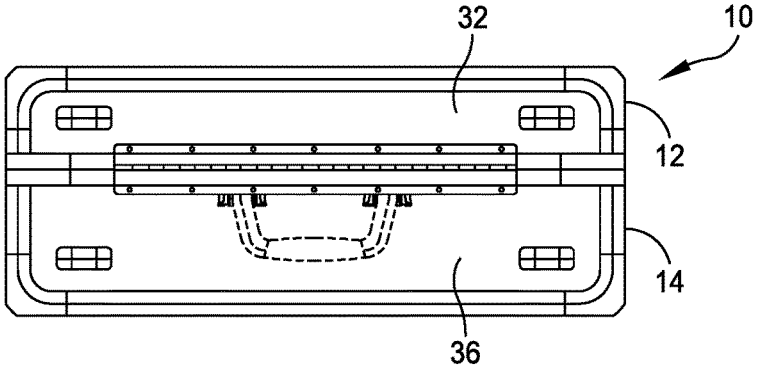
Figure 12D:
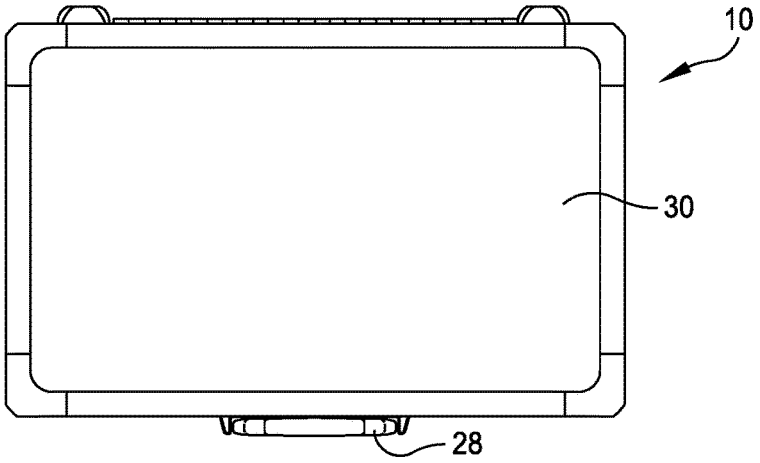
Figure 12E:
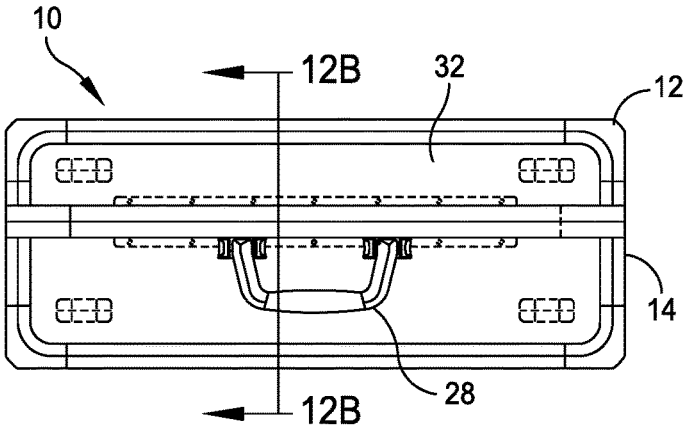
Figure 12F:
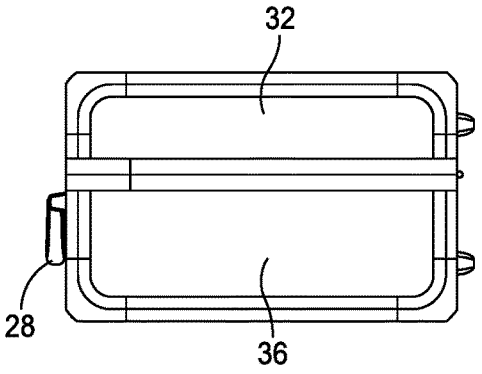

FIG. 11 shows exemplary dimensions of a single hinge 16A that can be used in place of the two hinges 16 in the embodiment of FIG. 1 to join the first shell 12 to the second shell 14.

Referring to FIG. 12, various views of a fully assembled article of luggage are illustrated. It is appreciated that like reference numbers are used for like components thereof and a description of each component is not repeated for the sake of brevity. FIGS. 12A-12F show the top panel 30, the bottom panel 31, and the side panels 32, 36 secured together by the configurable first and second frames of the article of luggage 10.

Figure 13A:
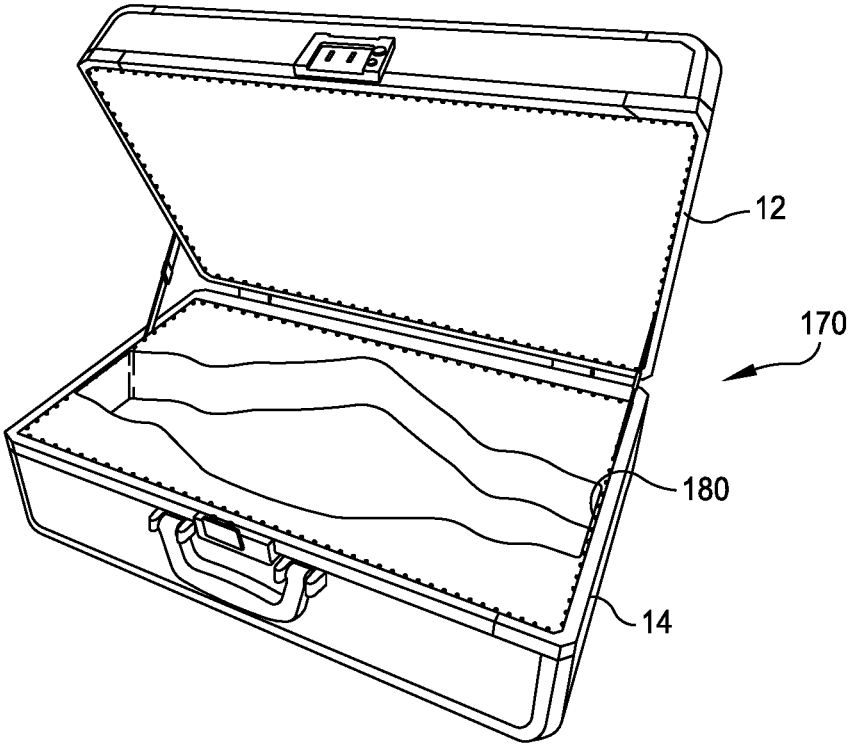
FIG. 13A is a view of an embodiment of a luggage of the present disclosure including lights for illuminating an item displayed in the luggage when the luggage is in an open condition.

FIG. 13A is a view of an embodiment of the article of luggage 170 of the present disclosure that further includes lights 180, such as LED lights, secured to an inner surface of the inner compartment of the luggage for illuminating an item displayed in the luggage when the luggage is in an open condition. Aspects and embodiments include, for example, LED lights arranged around a periphery of the central (main) frame of the first configurable shell and the second configurable shell. In some embodiments, when the luggage is in an open condition, lights secured to the interior of the luggage may be illuminated to provide lighting on a product supported within the luggage. It is appreciated that according to aspects and embodiments of the disclosure, the lights may include one or more light emitting diodes (LEDs) or other lights. The lights may be spaced apart around the perimeter of the opening of the luggage. The lights may be secured to the first shell and/or the second shell. The lights may be configured to illuminate when the first shell is rotated to the open condition relative to the second shell. In some embodiments, the lights are configured to illuminate when the first shell is rotated about the hinge beyond a threshold rotational angle with respect to the second shell. In some embodiments, the lights are configured to turn on when a user operates a switch to provide power to the lights.

Figure 13B:
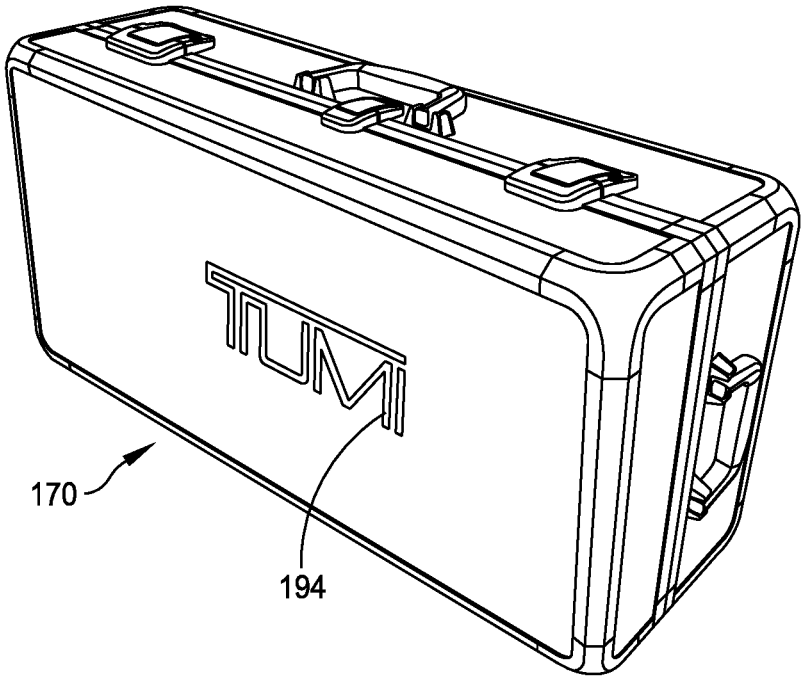
FIG. 13B is another view of the embodiment of luggage of FIG. 13A.

FIG. 13B shows the luggage of FIG. 13A in a closed condition, with the lights illuminating a feature 194 on the outer surface of the first shell 12. In some embodiments, the illuminated feature is in the form of text or a shape. In some embodiments, the illuminated feature is in the form of an illuminated logo.

By using a modular frame of the present disclosure, a piece of hard shell luggage may be constructed in one of a variety of form factors to meet the needs of a user. For example, the components of the modular frame may be sized to provide a desired length, width, and height of a piece of hard shell luggage.

Thus, the modular suitcase of the present disclosure may be constructed using a novel and efficient method for manufacturing luggage of varying designs and dimensions. Dimensions in the figures may be in hundredths of an inch, millimeters, or other units. Examples of the present disclosure may be constructed using modular components that may be readily mass produced, easily adapted to luggage of varying sizes, and quickly assembled from just a few simple components. Thus, the present disclosure provides a more efficient method for manufacturing luggage as well as an article of luggage that may be easily repaired using the same, mass-produced parts. Furthermore, the components of the present disclosure may also be easily adapted for use with suitcases of varying sizes and dimensions. For example, the suitcase components described with respect to the disclosed examples would be suitable for a wide range of suitcase sizes and dimensions. All other modular components described herein may be used with a hard shell luggage of virtually any size or dimensions, without the need for manufacturing unique hardware components for separate hard shell luggage designs.

While the disclosed subject matter is described herein in terms of certain examples, those skilled in the art will recognize that various modifications and improvements can be made to the disclosed subject matter without departing from the scope thereof. As such, the particular features claimed below and disclosed above can be combined with each other in other manners within the scope of the disclosed subject matter such that the disclosed subject matter should be recognized as also specifically directed to other examples having any other possible permutations and combinations. It will be apparent to those skilled in the art that various modifications and variations can be made in the systems and methods of the disclosed subject matter without departing from the spirit or scope of the disclosed subject matter. Thus, it is intended that the disclosed subject matter include modifications and variations that are within the scope of the appended claims and their equivalents.

The invention claimed is:

1. A luggage case shell, comprising:

a configurable frame assembly comprising an upper outer frame subassembly, an upper inner frame subassembly, and a central frame subassembly;

wherein the upper outer frame subassembly and upper inner frame subassembly each include corner pieces and elongate elements, the corner pieces and elongate members of the upper outer frame subassembly and the upper inner frame subassembly together define an upper frame subassembly including a first groove and a portion of at least one groove;

wherein the central frame assembly includes elongate members and corner members common to both the upper inner and upper outer frame subassemblies and connected to them so as to form a remainder of the portion of the at least one groove defined by the upper outer frame subassembly, the upper inner frame subassembly, and the central frame subassembly; and a first rigid panel disposed in the first groove.

2. The luggage case shell of claim 1, wherein the elongate members of the configurable frame assembly are configurable in length so as to provide the configurable frame assembly that is configurable in length, width, and depth.

3. The luggage case shell of claim 1, wherein the upper inner and upper outer frame subassemblies are configured to connect together at the corners.

4. The luggage case shell of claim 1, wherein the at least one groove comprises four additional grooves.

5. The luggage case shell of claim 4, wherein the first rigid panel is disposed in the first groove and four additional rigid side panels are disposed in the four additional grooves to comprise a configurable luggage case shell.

6. The luggage case shell of claim 1, wherein:

the upper outer frame subassembly includes:

four upper outer frame longitudinal frame members;

four upper outer frame vertical members; and four upper outer frame corner frame members, each upper outer frame corner member being connectable to two of the upper outer frame longitudinal frame members and to a first end of one of the upper outer frame vertical members; and the upper inner frame subassembly includes:

four upper inner frame longitudinal frame members;

four upper inner frame vertical members; and four upper inner frame corner frame members, each upper inner frame corner member being connectable to two of the upper inner frame longitudinal frame members and to a first end of one of the upper inner frame vertical members.

7. The luggage case shell of claim 6, wherein the central frame includes:

four central frame longitudinal frame members; and four central frame corner frame members, each central frame corner frame member including an inner corner frame portion and an outer corner frame portion defining an upper central frame corner recess therebetween, each upper central frame corner member being connectable to a second end of one of the upper frame vertical members;

the four upper outer frame longitudinal frame members, the four upper outer frame vertical members, the four upper outer frame corner frame members, the four upper inner frame longitudinal frame members, the four upper inner frame vertical members, the four upper inner frame corner frame members, the four central frame longitudinal frame members, and the four central frame corner frame members connected together to define the configurable frame including the first groove and wherein the at least one groove includes, first, second, third, fourth and fifth grooves of a first configurable shell.

8. The luggage case shell of claim 7, wherein the first rigid panel is sized and configured to be disposed in the first groove, and further comprising second, third, fourth and fifth rigid side panels that are sized and configured to be housed in respective second, third, fourth and fifth grooves of the first configurable shell.

9. The luggage case shell of claim 6, wherein each upper inner frame corner member is secured to one of the four upper inner vertical members.

10. The luggage case shell of claim 6, wherein each upper inner frame corner member includes a post received in a recess defined in one of the four upper inner vertical members.

11. The luggage case shell of claim 6, wherein each upper inner frame corner member is secured to one of the upper outer frame vertical members by at least one fastener.

12. The luggage case shell of claim 6, wherein each upper outer-frame corner member includes at least one post received in a recess defined in a first end one of the upper outer frame vertical members.

13. The luggage case shell of claim 6, wherein each upper outer-frame corner member includes at least a post received in a recess defined in an end one of the upper outer frame horizontal members.

14. The luggage case shell of claim 6, wherein each upper central frame corner member includes at least one post received in a recess defined in a second end of one of the upper outer frame vertical members.

15. The luggage case shell of claim 14, wherein each upper central frame corner member includes at least a second post received in a recess defined in an end of one of the central frame horizontal members.

16. The luggage case shell of claim 6, wherein a length of the four upper outer frame longitudinal frame members, the four upper inner frame longitudinal frame members, and the four central frame longitudinal frame members is configurable to define a desired length and width of a first configurable shell.

17. The luggage case shell of claim 6, wherein a length of the four upper outer frame vertical members and a length of the four upper inner frame vertical members is configurable to define a desired height or depth of a first configurable shell.

18. An article of luggage comprising:

a first luggage case shell comprising the luggage case shell of claim 1;

a second luggage case shell comprising the luggage case shell of claim 1; and at least one hinge connecting the first luggage case shell to the second luggage case shell.

19. The article of luggage of claim 18, further comprising wheels and a handle.

20. The article of luggage of claim 18, further comprising an LED lighting arrangement housed within the at least the first luggage case shell of the article of luggage.

21. The article of luggage of claim 20, further comprising a logo defined through the first rigid panel, the LED lighting arrangement illuminating the logo when in an on condition.

* * * * *